US005561103A

United States Patent [19]

Tipton

[11] Patent Number: 5,561,103

[45] Date of Patent: Oct. 1, 1996

[54] FUNCTIONAL FLUID COMPOSITIONS HAVING IMPROVED FRICTIONAL AND ANTI-OXIDATION PROPERTIES

[75] Inventor: Craig D. Tipton, Perry, Ohio

[73] Assignee: The Lubrizol Corporation, Wickliffe, Ohio

[21] Appl. No.: 533,601

[22] Filed: Sep. 25, 1995

[51] Int. Cl.[6] ..... C10M 135/24

[52] U.S. Cl. ..... 508/189; 508/190; 508/194; 508/195; 508/198; 508/287; 508/421; 508/433; 508/435; 508/444; 508/570

[58] Field of Search ..... 252/48.2

[56] References Cited

U.S. PATENT DOCUMENTS

| | | | |
|---|---|---|---|
| 2,230,966 | 2/1941 | Reid et al. | 252/45 |
| 2,562,844 | 7/1951 | Harman | 252/48.2 |
| 2,566,157 | 8/1951 | Barker | 252/48.2 |
| 2,582,605 | 1/1952 | Richter et al. | 260/608 |
| 2,653,978 | 9/1953 | Doerr | 260/609 |
| 2,874,192 | 2/1959 | Cottle et al. | 252/48.2 |
| 3,219,666 | 11/1965 | Norman et al. | 252/51.5 A |
| 3,338,832 | 8/1967 | LeSuer | 252/49.6 |
| 3,359,203 | 12/1967 | O'Halloran | 252/46.6 |
| 3,702,300 | 11/1972 | Coleman | 252/51.5 |
| 4,032,461 | 6/1977 | Hoke | 252/46.7 |
| 4,208,357 | 6/1980 | Hoke | 260/978 |
| 4,209,410 | 6/1980 | Baldwin | 252/48.2 |
| 4,217,233 | 8/1980 | Michaelis | 252/48.2 |
| 4,282,171 | 8/1981 | Hoke | 260/928 |
| 4,455,243 | 6/1984 | Liston | 252/49.6 |
| 4,486,322 | 12/1984 | Horodysky et al. | 252/48.2 |
| 4,495,088 | 1/1985 | Liston | 252/32.7 |
| 4,584,115 | 4/1986 | Davis | 252/49.6 |
| 4,670,169 | 6/1987 | Adams et al. | 252/46.7 |
| 4,702,850 | 10/1987 | Gutierrez et al. | 252/48.2 |
| 4,758,362 | 7/1988 | Butke | 252/47.5 |
| 4,764,299 | 8/1988 | Salomon | 252/48.2 |
| 4,769,164 | 9/1988 | Salomon | 252/48.2 |
| 4,894,174 | 1/1990 | Salomon | 252/48.2 |
| 5,037,569 | 8/1991 | Salomon | 252/48.2 |
| 5,051,198 | 9/1991 | Salomon | 252/47 |
| 5,053,152 | 10/1991 | Steckel | 252/51.5 |

FOREIGN PATENT DOCUMENTS

| | | | |
|---|---|---|---|
| 1347845 | 2/1974 | United Kingdom | C07F 9/16 |
| WO88/05810 | 8/1988 | WIPO | C10M 163/00 |

OTHER PUBLICATIONS

Fokin et al. in Bull. Acad. Sci U.S.S.R., Div. Chem. Sci. pp. 1667–1672 (1982).

Mitsubishi Rayon (CA 72, 79858d 1970).

Richter et al. in Journal of Polymer Science 74 4076–4079, (1952).

Woodward in Journal of Polymer Science, XLI, 219–223 (1959).

Journal of Polymer Science, XLI, 231–239 (1959).

*Primary Examiner*—Ellen M. McAvoy

*Attorney, Agent, or Firm*—William J. Connors; Frederick D. Hunter

[57] ABSTRACT

Compositions of matter containing self condensation reaction products of alkylthio alkanols and dispersants which are found to have utility in lubricating/functional fluids.

29 Claims, No Drawings

FUNCTIONAL FLUID COMPOSITIONS HAVING IMPROVED FRICTIONAL AND ANTI-OXIDATION PROPERTIES

BACKGROUND OF THE INVENTION

1. Field of the Invention

Lubricating and functional fluids manufacturers are under constant pressure to improve their products in response to manufacturers' and user demands. For instance, General Motors recently released its DEXRON®-III specification, which requires fluids with improved friction performance and thermal stability. Major properties of fluids subject to improvement pressure are chemical and thermal stability which in turn leads to improved anti-oxidation and long term lubricating and functional properties. While solving a given set of problems in fluids, care must be taken to also improve or at least retain other properties or operating parameters of the fluid. An example of this is to formulate lubricating fluids with improved or at least comparable anti-oxidation properties while retaining or improving functional properties imparted by the lubricating fluid while in use. The present invention deals with fluids whose functional properties have been improved by the addition of an additive package containing bis(alkylthioalkyl) ethers to the basic lubricating fluid to form a lubricating composition.

2. Description of the Art

Bis(alkylthioalkyl) ethers are known in the art. Their synthesis from 2-thioalkylethanols has been disclosed in U.S. Pat. No. 2,653,978 to Monsanto. Fokin et al in Bull. Acad. Sci U. S. S. R., Div. Chem. Sci. pp. 1667–1672 (1982) has also reported the self condensation products of alkyl substituted 2-thio ethanols to form the corresponding bis-(alkylthioalkyl) ethers. The thio analog bis(alkylthioethyl) sulfide has been reported in Japanese patent 6,926,196 to Mitsubishi Rayon (CA 72, 79858d 1970). The above cited references reported the dodecyl compounds. All sulfur analogs have also been described and their use in lubricants reported in U.S. Pat. No. 2,230,966 to Socony-Vacuum Oil Company.

Condensation reactions of 2-hydroxyethyl sulfides with alcohols and phenols to yield the corresponding bis-(2-alkoxyethyl)sulfide and their use as lubricants has been reported by Richter et al in U.S. Pat. No. 2,582,605 to Socony-Vacuum Oil Company and by Richter et al in Journal of Polymer Science 74, 4076– 4079, (1952). Woodward in Journal of Polymer Science, XLI, 219–223 (1959) reported on the autocondensation of thiodiglycol to give unspecified products. Andrews et al reported on the condensation of aliphatic hydroxy compounds with thiodiglycols in Journal of Polymer Science, XLI, 231–239 (1959).

Solomon, in U.S. Pat. Nos. 4,769,164 and 5,037,569 has synthesized anti-oxidant products for inclusion in functional fluids. The anti-oxidants are produced from condensation reactions of thiodialkanols with monohydric alcohols and hindered phenols. These sulfur containing products are of general formula $ROCH_2CH_2SCH_2CH_2OR$. In U.S. Pat. Nos. 4,764,299, 4,894,174 and 5,051,198 the reaction products of thiodiglycols with mercaptans are disclosed. In one embodiment the reaction products have formula RSASASR where A is alkylene and a composition which is the reaction products of a beta-thiodialkanol and a mercaptan.

U.S. Pat. No. 5,053,152 discloses dispersants for use in lubricant and fuel compositions obtained by condensing a hydroxyalkyl or hydroxyaryl compounds with amines.

These dispersants are produced by the acid catalyzed condensation of the amine reactant with the hydroxy reactant. The reference indicates that the examples disclose the preparation of dispersants with high TBN (total base number) values in the range of 75–85. The reference also indicates that lubricants and functional fluids (e.g., automatic transmission fluids) containing these dispersants can also include zinc dialkyl phosphorodithioates.

U.S. Pat. No. 4,584,115 discloses that reaction products of boric acid or boron trioxide with epoxides having at least 8 carbon atoms are useful antiwear, friction-modifying and rest-inhibiting additives for lubricants. U.S. Pat. Nos. 4,455,243 and 4,495,088 disclose lubricating oils containing borated partial fatty acid esters of glycerol.

The use of phosphorus containing amides as antiwear agents for use in lubricant compositions is disclosed in U.S. Pat. Nos. 4,032,461; 4,208,357; 4,282,171; and 4,670,169. Phosphorus-containing esters useful as antiwear agents in lubricating compositions are disclosed in U.S. Pat. No. 3,359,203. The use of such esters as E.P. agents in lubricant compositions is disclosed in U.K Patent 1,347,845. WO 88/05810 discloses gear oil compositions which contain hydrocarbyl phosphite esters where the hydrocarbyl groups have 1 to 30 carbon atoms.

U.S. Pat. No. 4,758,362 discloses thiocarbamate additives for use in low phosphorus or phosphorus-free lubricating compositions. The additive has the formula $$R_1R_2NC(=X)-S(CR_3R_4)_aZ$$

wherein X is O or S, and Z is one of several listed groups. The reference indicates that these additives impart improved extreme-pressure and antiwear properties to lubricant compositions.

U.S. Pat. No. 3,702,300 discloses carboxy-containing interpolymers in which some of the carboxy groups are esterified and the remaining carboxy groups are neutralized by reaction with a polyamine having one primary or secondary amino group. These interpolymers are described as being useful as additives for use in lubricating compositions and fuels.

The present invention describes and claims compositions containing reaction products which are alkylthio derivatives of alkyl ethers which when incorporated in functional fluids or lubricating base fluids result in fluid composition having superior frictional and anti-oxidation properties. The above references are herein incorporated by reference for any portion pertinent to this invention.

SUMMARY OF THE INVENTION

The present invention describes a class of compounds being alkylthio derivatives of alkylethers. The alkythioalkylethers are used as additives to functional fluids and lubricating fluids to provide composition of improved functional properties. In this specification, all weight percents of the various components for an additive package or for incorporation in a fully formulated functional/lubricating fluid are on an oil-free basis. The thioethers are self-condensation reaction products of thioalkanols and have the general formula $$RS\overset{R^1}{\overset{|}{C}}H\overset{R^1}{\overset{|}{C}}HO\overset{R^1}{\overset{|}{C}}H\overset{R^1}{\overset{|}{C}}HSR \qquad \text{I}$$

wherein $R=C_4-C_{20}$ $R^1$=hydrogen or hydrocarbyl

The self condensation reaction products of this invention are particularly effective when used in admixture with selected dispersants. This combination of self condensation product, with selected dispersants comprise a part of this invention.

In addition to the self condensation products and dispersants, boron in way of a borated dispersant or other borated compounds forms a part of this invention. The self condensation product I, dispersants and boron form parts of an additive package which when added to a base lubricating fluid or functional fluid forms a lubricating composition.

The thioalkanols used in self condensation reactions to form the thioether reaction products of the invention have formula

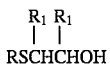

wherein $R=C_6-C_{20}$ $R^1$=hydrogen or hydrocarbyl

The thioalkanols reaction products can be prepared in known manners and in general may be prepared by the reaction of a mercaptan with an epoxide as illustrated by:

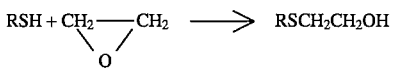

The thioalkohols may aim be prepared by reacting a mercapto alcohol with an alkene as illustrated by:

$$HS(CH_2)_2OH+CH_2{=}CH_2 \rightarrow CH_3CH_2S(CH_2)_2OH$$

These synthetic methods can be found in U.S. Pat. Nos. 4,031,023 to Musser et al and U.S. Pat. No. 2,653,978 to Doerr. The patents are incorporated herein by reference for disclosure related to this invention.

Self condensation of the starting alkylthio alcohol is described in the '978 patent listed above. In this reference the thioalkanol which has been formed by a mercapto addition to an epoxide, was self condensed under the influence of an acid to yield the bis(alkylthioalkyl) ether reaction products.

In use, the self condensation reaction products together with a dispersant are incorporated into various lubricating or functional base fluids of selected viscosities designed for specific applications. The dispersants preferred in this invention are described in U.S. Pat. No. 5,053,152, and progeny and in general are known in the art as "succan" dispersants because they are based on succinic or equivalent acylating agents which have been reacted with a polyamine. U.S. Pat. No. 5,053,152 is hereby incorporated herein by reference for disclosure pertinent to this invention.

A second group of dispersants in use in the invention are borated acylated amines. The borated acylated amines are prepared according to U.S. Pat. Nos. 3,087,936, 3,254,025, and 5,110,488 which are hereby incorporated herein by reference for disclosure pertinent to this invention.

The borated dispersant, which is also a part of this invention, adds boron to the additive package and in turn to the fluid compositions in the amount of about 0.01–1.0 weight percent based on the weight of the fluid composition.

DESCRIPTION OF THE PREFERRED EMBODIMENTS

In use, lubricating or functional fluid compositions are formulated containing the self condensation reaction products of the thioalkanols and the dispersants listed above for this invention are dissolved in a base lubricating fluid of viscosity appropriate for the intended use. The self condensation reaction products comprise 0.5–5 weight percent of the fluid composition with a preferred range of 1–3 weight percent. The dispersants represent about 2–8 weight percent of the fluid composition, with the preferred range being 3–5 weight percent. While there is wide latitude in the weight ratio of the acylated polyamine to the borated acylamine, and while only one of the dispersants may be used in any formulation, it is preferred that boron comprise 0.005–2.0 weight percent of the fluid composition. The fluid compositions comprise greater than 50% and up to about 90–95% of a base lubricating fluid with the preferred range being 80–90%. Lubricants and functional fluids for the purpose of this invention include transmission fluids, crankcase oils, oils for two cycle engines, brake fluids, hydraulic fluids, gear lubricants, metal working lubricants and the like. Transmission fluids are the preferred products of this invention.

Alkylthio alcohol synthesis

Alkylthioalkanols are prepared by the reaction of a mercaptan with an epoxide under Alkaline conditions. For example, as reported in U.S. Pat. No. 4,031,023:

While allowing the temperature to increase from 40° C. to 135° C., a reaction mixture is prepared by the addition of 580 parts (10 moles) of propylene oxide to 2020 parts (10 moles) of tertiary dodecyl mercaptan and 14 parts of a 50% aqueous solution of sodium hydroxide. The reaction mixture is held at 115°–120° C. for 3 hours, stripped to 120° C. under vacuum and filtered. The filtrate (2597 parts) is the desired hydroxy thioether which is primarily the monocondensation product of the mercaptan and propylene oxide.

Bis(alkylthioalkyl) ether synthesis

Self condensation reaction products are prepared by the acid catalyzed reaction of the alkylthio alkanols. For example, as reported in U.S. Pat. No. 2,653,978:

A 3-necked, round-bottom flask was provided with a thermometer, and efficient rotary stirring device and a dropping funnel. The vessel was charged with 109.2 grams of β-(n-decylmercapto) ethanol which was prepared by condensing equimolecular quantities of n-decyl mercaptan and ethylene oxide, and also with 200 grams of dry carbon tetrachloride. The solution was cooled to 25° C. and 75 grams of 100 percent sulfuric acid was added dropwise at a rate which permitted the maintenance of a temperature between 25° and 30° C. by immersion of the vessel in an ice bath. The resulting thick reaction mass was diluted with water, dissolved in ethanol, and neutralized with 40 percent sodium hydroxide solution. Solid sodium sulfate was precipitated and was removed by filtration of the hot ethanol solution which upon cooling produced a solid crystalline water-insoluble substance having a melting point of 43°–44°C. This product was identified as β,β'-bis(n-decylmercapto)diethyl ether.

As used in this specification and in the appended claims, the term "hydrocarbyl" denotes a group having a carbon atom directly attached to the remainder of the molecule and having a hydrocarbon or predominantly hydrocarbon character. Such groups include the following:

(1) Hydrocarbon groups; that is, aliphatic, (e.g., alkyl or alkenyl), alicyclic (e.g., cycloalkyl or cycloalkenyl), aromatic, and alicyclic-substituted aromatic, aromatic-substituted aliphatic and alicyclic groups, and the like, as well as cyclic groups wherein the ring is completed through another portion of the molecule (that is, any two indicated substituents may together form an alicyclic group). Such groups are known to those skilled in the art. Examples include methyl, ethyl, octyl, decyl, octadecyl, cyclohexyl, phenyl, etc.

(2) Substituted hydrocarbon groups; that is, groups containing non-hydrocarbon substituents which, in the context of this invention, do not alter the predominantly hydrocarbon character of the group. Those skilled in the art will be aware of suitable substituents. Examples include halo, hydroxy, nitro, cyano, alkoxy, acyl, etc.

(3) Hetero groups; that is, groups which, while predominantly hydrocarbon in character within the context of this invention, contain atoms other than carbon in a chain or ring otherwise composed of carbon atoms. Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydrocarbyl group.

Terms such as "alkyl-based," "aryl-based," and the like have meanings analogous to the above with respect to alkyl groups, aryl groups and the like.

The term "hydrocarbon-based" has the same meaning and can be used interchangeably with the term hydrocarbyl when referring to molecular groups having a carbon atom attached directly to the remainder of a molecule.

The term "lower" as used herein in conjunction with terms such as hydrocarbyl, alkyl, alkenyl, alkoxy, and the like, is intended to describe such groups which contain a total of up to 7 carbon atoms.

(A) Acylated Amines.

The acylated amines (A) that are useful with the inventive automatic transmission fluids are made by contacting (A)(I) a carboxylic acid acylating agent with (A)(II) a polyamine to provide an acylated amine characterized by a base number in the range of up to about 200, and in one embodiment about 50 to about 150. The term "base number" or "total base number (TBN)" as used herein refers to the amount of acid (perchloric or hydrochloric) needed to neutralize the product (A), excluding diluent oil and unreacted components, expressed as KOH equivalents.

(A)(I) Carboxylic Acid Acylating Agents.

The acylating agents (A)(I) are well known in the art and have been found to be useful as additives for lubricants and fuels and as intermediates for preparing the same. See, for example, the following U.S. Patents which are hereby incorporated by reference for their disclosures relating to carboxylic acid acylating agents: 3,219,666; 3,272,746; 3,381,022; 3,254,025; 3,278,550; 3,288,714; 3,271,310; 3,373,111; 3,346,354; 3,272,743; 3,374,174; 3,307,928; and 3,394,179.

Generally, these carboxylic acid acylating agents are prepared by reacting an olefin polymer or chlorinated analog thereof with an unsaturated carboxylic acid or derivative thereof such as acrylic acid, fumaric acid, maleic anhydride and the like. Often they are polycarboxylic acylating agents such as hydrocarbyl-substituted succinic acids and anhydrides. These acylating agents generally have at least one hydrocarbyl substituent of at least about 8 carbon atoms, and in one embodiment at least about 12 carbon atoms, and in one embodiment at least about 20 carbon atoms, and in one embodiment at least about 30 carbon atoms, and in one embodiment at least about 50 carbon atoms. Generally, this substituent has an average of about 12 or about 20, typically about 30 or about 50 up to about 300 or about 500 carbon atoms; often it has an average of about 50 to about 250 carbon atoms.

The olefin monomers from which the olefin polymers are derived are polymerizable olefins and monomers characterized by having one or more ethylenic unsaturated group. They can be monoolefinic monomers such as ethylene, propylene, butene-1, isobutene and octene-1 or polyolefinic monomers (usually di-olefinic monomers such as butadiene-1,3 and isoprene). Usually these monomers are terminal olefins, that is, olefins characterized by the presence of the group $>C{=}CH_2$. However, certain internal olefins can also serve as monomers. When such olefin monomers are used, they normally are employed in combination with terminal olefins to produce olefin polymers which are interpolymers. Although the hydrocarbyl-based substituents may also include aromatic groups (especially phenyl groups and lower alkyl and/or lower alkoxy-substituted phenyl groups such as para(tertiary butyl)-phenyl groups) and alicyclic groups such as would be obtained from polymerizable cyclic olefins or alicyclic-substituted polymerizable cyclic olefins. The olefin polymers are usually free from such groups. Nevertheless, olefin polymers derived from such interpolymers of both 1,3-dienes and styrenes such as butadiene-1,3 and styrene or para(tertiary butyl)styrene are exceptions to this general rule.

Generally, the olefin polymers are homo- or interpolymers of terminal hydrocarbyl olefins of about 2 to about 16 carbon atoms. A more typical class of olefin polymers is selected from that group consisting of homo- and interpolymers of terminal olefins of 2 to 6 carbon atoms, especially those of 2 to 4 carbon atoms.

Specific examples of terminal and medial olefin monomers which can be used to prepare the olefin polymers from which the hydrocarbyl substituents are derived include ethylene, propylene, butene-1, butene-2, isobutene, pentene-1, hexene-1, heptene-1, octene-1, nonene-1, decene-1, pentene-2, propylene tetramer, diisobutylene, isobutylene trimer, butadiene-1,2, butadiene-1,3, pentadiene-1,2, pentadiene-1,3, isoprene, hexadiene-1,5, 2-chlorobutadiene-1,3, 2-methylheptene- 1, 3 -cyclohexylbutene-1,3,3 -dimethylpentene-1, styrene, divinylbenzene, vinylacetate, allyl alcohol, 1-methylvinylacetate, acrylonitrile, ethylacrylate, ethylvinylether and methylvinylketone. Of these, the purely hydrocarbyl monomers are more typical and the terminal olefin monomers are especially typical.

Often the olefin polymers are poly(isobutene)s such as obtained by polymerization of a $C_4$ refinery stream having a butene content of about 35% to about 75% by weight and an isobutene content of about 30% to about 60% by weight in the presence of a Lewis acid catalyst such as aluminum chloride or boron trifluoride. These polyisobutenes usually contain predominantly (that is, greater than 80% of the total repeat units) isobutene repeat units of the configuration

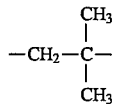

Often the acylating agents (A)(I) are substituted succinic acids or anhydrides which can be represented by the formulae

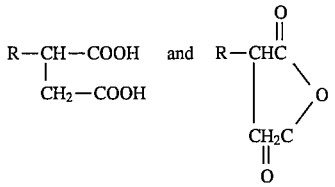

wherein R is a hydrocarbyl group (eg., alkyl or alkenyl) of about 12 to 500 carbon atoms, and in one embodiment about 30 to about 500 carbon atoms, and in one embodiment about 50 to about 500 carbon atoms.

These succinic acid acylating agents can be made by the reaction of maleic anhydride, maleic acid, or fumaric acid with the afore-described olefin polymer, as is shown in the patents cited above. Generally, the reaction involves merely heating the two reactants at a temperature of about 150° C. to about 200° C. Mixtures of the afore-said polymeric olefins, as well as mixtures of unsaturated mono- and dicarboxylic acids can also be used.

In one embodiment the acylating agent (A)(I) is a substituted succinic acid or anhydride, said substituted succinic acid or anhydride consisting of substituent groups and succinic groups wherein the substituent groups are derived from polybutene in which at least about 50% of the total units derived from butenes are derived from isobutylene. The polybutene has a $\overline{Mn}$ value of about 800 to about 1200 and a $\overline{Mn}/\overline{Mw}$ value of about 2 to about 3. The acids or anhydrides are characterized by the presence within their structure of an average of about 0.9 to about 1.2 succinic groups for each equivalent weight of substituent groups. For purposes of this invention, the number of equivalent weights of substituent groups is the number corresponding to the quotient obtained by dividing the $\overline{Mn}$ value of the polyalkene from which the substituent is derived into the total weight of the substituent groups present in the substituted succinic acid. Thus, if a substituted succinic acid is characterized by a total weight of substituent group of 40,000 and the Mn value for the polyalkene from which the substituent groups are derived is 2000, then that substituted succinic acylating agent is characterized by a total of 20 (40,000/2000=20) equivalent weights of substituent groups.

(A)(II) Polyamine.

The polyamine (A)(II) is selected from the group consisting of (A)(II)(a) a condensed polyamine derived from at least one hydroxy material and at least one amine, (A)(II)(b) an alkylene polyamine bottoms product, or (A)(II)(c) a condensed polyamine derived from at least one hydroxy material and at least one alkylene polyamine bottoms product.

Hydroxy Material Used in Making Condensed Polyamines (A)(II)(a) and (A)(II)(c).

The hydroxy material used in making (A)(II)(a) or (A)(II)(c) can be any hydroxy material that will condense with the amine reactants referred to above and discussed below. These hydroxy materials can be aliphatic, cycloaliphatic or aromatic alcohols. These alcohols can be monohydric or polyhydric.

The hydroxy materials include alkylene glycols and polyoxyalkylene alcohols such as polyoxyethylene alcohols, polyoxypropylene alcohols, polyoxybutylene alcohols, and the like. These polyoxyalkylene alcohols (sometimes called polyglycols) can contain up to about 150 oxyalkylene groups, with the alkylene group containing from about 2 to about 8 carbon atoms. Such polyoxyalkylene alcohols are generally dihydric alcohols. That is, each end of the molecule terminates with an OH group. In order for such polyoxyalkylene alcohols to be useful, there must be at least one such OH group. However, the remaining OH group can be esterified with a monobasic, aliphatic or aromatic carboxylic acid of up to about 20 carbon atoms such as acetic acid, propionic acid, oleic acid, stearic acid, benzoic acid, and the like. The monoethers of these alkylene glycols and polyoxyalkylene glycols are also useful. These include the monoaryl ethers, monoalkyl ethers, and monoaralkyl ethers of these alkylene glycols and polyoxyalkylene glycols. This group of alcohols can be represented by the formula $$HO—(—R^1O—)_pR^2—OR^3$$

wherein $R^1$ and $R^2$ are independently alkylene groups of from about 2 to 8 carbon atoms; and $R^3$ is aryl (e.g., phenyl), lower alkoxy phenyl, or lower alkyl phenyl, or lower alkyl (e.g., ethyl, propyl, terbutyl, pentyl, etc.); and aralkyl (e.g., benzyl, phenylethyl, phenylpropyl, p-ethylphenylethyl, etc.); p is from zero to about eight, preferably from about 2 to 4. Polyoxyalkylene glycols where the alkylene groups are ethylene or propylene and p is at least two as well as the monoethers thereof as described above are useful.

The hydroxy materials that are useful include polyhydroxy aromatic compounds, especially the polyhydric phenols and naphthols. These hydroxysubstituted aromatic compounds may contain other substituents in addition to the hydroxy substituents such as halo, alkyl, alkenyl, alkoxy, alkylmercapto, nitro and the like. Usually, the hydroxy aromatic compound will contain from 1 to about 4 hydroxy groups. The aromatic hydroxy compounds are illustrated by the following specific examples: beta-naphthol, alpha-naphthol, cresols, resorcinol, catechol, thymol, eugenol, p,p'-dihydroxy-biphenyl, hydroquinone, pyrogallol, phloroglucinol, hexylresorcinol, 4,4'-methylene-bis-phenol, alpha-decyl-beta-naphthol, the condensation product of heptylphenol with about 0.5 mole of formaldehyde, the condensation product of octylphenol with acetone, di(hydroxyphenyl)oxide, di-(hydroxyphenyl)sulfide, and di(hydroxyphenyl)-disulfide.

Examples of monohydric alcohols which can be used include methanol, ethanol, isooctanol, dodecanol, cyclohexanol, cyclopentanol, behenyl alcohol, hexatriacontanol, neopentyl alcohol, isobutyl alcohol, benzyl alcohol, beta-phenylethyl alcohol, 2-methylcyclohexanol, beta-chloroethanol, monomethyl ether of ethylene glycol, monobutyl ether of ethylene.

Other specific alcohols that can be used are the ether alcohols and amino alcohols including, for example, the oxyalkylene-, oxyarylene-, aminoalkylene-, and amino-arylene-substituted alcohols having one or more oxyalkylene, aminoalkylene or amino-aryleneoxy-arylene groups. These alcohols are exemplified by the Cellosolves, (products of Union Carbide identified as mono- alkyl ethers of ethylene glycol and their derivatives), the Carbitols (products of Union Carbide identified as mono- and dialkyl ethers of diethylene glycol and their derivatives), mono-(heptylphenyloxypropylene)-substituted glycerol, poly(styreneoxide), aminoethanol, di(hydroxyethyl)amine, N,N,N',N'-tetrahydroxytrimethylenediamine, and the like.

In one embodiment, the polyhydric alcohols contain from 2 to about 10 hydroxy groups. Those containing two hydroxy groups are illustrated, for example, by the alkylene glycols and polyoxyalkylene glycols mentioned above such as ethylene glycol, diethylene glycol, triethylene glycol, tetraethylene glycol, dipropylene glycol, tripropylene glycol, dibutylene glycol, tributylene glycol, and other alkylene glycols and polyoxyalkylene glycols in which the alkylene groups contain from 2 to about 8 carbon atoms.

Useful alcohols also include those polyhydric alcohols containing up to about 12 carbon atoms, and especially those containing from about 3 to about 10 carbon atoms. This class of alcohols includes glycerol, erythritol, pentaerythritol, dipentaerythritol, gluconic acid, glyceraldehyde, glucose, arabinose, 1,7-heptanediol, 2,4-heptanediol, 1,2,3-hexanetriol, 1,2,4-hexanetriol, 1,2,5-hexanetriol, 2,3,4-hexanetriol, 1,2,3-butanetriol, 1,2,4-butanetriol, quinic acid, 2,2,6,6-tetrakis-(hydroxymethyl)cyclohexanol, 1,10-decanediol, digitalose, and the like. Aliphatic alcohols containing at least about 3 hydroxyl groups and up to about 10 carbon atoms are useful.

Amino alcohols contemplated as suitable for use as the hydroxy-containing reactant include those amino alcohols having two or more hydroxy groups. Examples of suitable amino alcohols are the N-(hydroxy-lower alkyl)amines and polyamines such as di-(2-hydroxyethyl)-amine, tris(hydroxymethyl)amino methane (THAM), tri-(2-hydroxyethyl)amine, N,N,N'-tri-(2-hydroxyethyl)ethylenediamine, N-(2-hydroxypropyl)-5-carbethoxy- 2-piperidone, and ethers thereof with aliphatic alcohols, especially lower alkanols, N,N-di-(3-hydroxypropyl)glycine, and the like. Also contemplated are other poly-N-hydroxyalkyl-substituted alkylene polyamines wherein the alkylene polyamine are as described above; especially those that contain 2 to 3 carbon atoms in the alkylene radicals.

Polyoxyalkylene polyols which have two or three hydroxyl groups and contain hydrophobic portions represented by the formula $$-\underset{\underset{R^1}{|}}{CH}CH_2O-$$

wherein $R^1$ is a lower alkyl of up to 3 carbon atoms, and hydrophilic portions containing—$CH_2CH_2O$— groups are useful. These polyols can be prepared by first reacting a compound of the formula $R^2(OH)_q$ where q is 2–3 and $R^2$ is hydrocarbyl with a terminal alkylene oxide of the formula

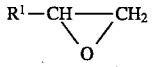

and then reacting that product with ethylene oxide. $R^2(OH)_q$ can also be, for example, trimethylolpropane, trimethylolethane, ethylene glycol, trimethylene glycol, tetramethylene glycol, tri-(beta-hydroxypropyl)amine, 1,4-(2-hydroxyethyl)cyclohexane, tris(hydroxymethyl)amino methane, 2-amino-2-methyl-1,3-propanediol, N,N,N',N'-tetrakis(2-hydroxypropyl)ethylene diamine, N,N,N',N'-tetrakis(2-hydroxyethyl)-ethylene diamine, resorcinol, and the like. The foregoing described $R^2(OH)_q$ polyols may also be used alone as the hydroxy-containing reactant.

Other hydroxy-containing reactants that can be used are hydroxyalkyl, hydroxy alkyl oxyalkyl and hydroxy aryl sulfides of the formula $$S_f(ROH)_2$$

wherein f is 1 or 2, and R is an alkyl of 1 to about 10 carbon atoms or an alkyl oxyalkyl where the alkyl is 1 to about 10 carbon atoms and in one embodiment 2 to about 4 carbon atoms. Examples include 2,2'-thiodiethanol and 2,2'-thiodipropanol.

Amines Useful in Making the Polyamines (A)(II)(a).

The amines useful in making the polyamines (A)(II)(a) include primary amines and secondary amines. These amines are characterized by the presence within their structure of at least one H—N< group and/or at least one $-NH_2$ group. These amines can be monoamines or polyamines, with the polyamines being preferred. Mixtures of two or more amines can be used.

The amines can be aliphatic, cycloaliphatic, aromatic or heterocyclic, including aliphatic-substituted aromatic, aliphatic-substituted cycloaliphatic, aliphatic-substituted heterocyclic, cycloaliphatic-substituted aliphatic, cycloaliphatic-substituted aromatic, cycloaliphatic-substituted heterocyclic, aromatic-substituted aliphatic, aromatic-substituted cycloaliphatic, aromatic-substituted heterocyclic, heterocyclic-substituted aliphatic, heterocyclic-substituted cycloaliphatic and heterocyclic-substituted aromatic amines. These amines may be saturated or unsaturated. If unsaturated, the amine is preferably free from acetylenic unsaturation. The amines may also contain non-hydrocarbon substituents or groups as long as these groups do not significantly interfere with the reaction of the amines with the hydroxy materials used in making the condensed polyamines (A)(II)(a). Such non-hydrocarbon substituents or groups include lower alkoxy, lower alkyl, mercapto, nitro, and interrupting groups such as —O— and —S— (e.g., as in such groups as —$CH_2CH_2$—X—$CH_2CH_2$— where X is —O—or —S—).

With the exception of the branched polyalkylene polyamines, the polyoxyalkylene polyamines and the high molecular weight hydrocarbyl-substituted amines described more fully hereinafter, the amines used in this invention ordinarily contain less than about 40 carbon atoms in total and usually not more than about 20 carbon atoms in total.

Aliphatic monoamines include mono-aliphatic and di-aliphatic-substituted amines wherein the aliphatic groups can be saturated or unsaturated and straight or branched chain. Thus, they are primary or secondary aliphatic amines. Such amines include, for example, mono- and di-alkyl-substituted amines, mono- and di-al-kenyl-substituted amines, and amines having one N-alkenyl substituent and one N-alkyl substituent, and the like. The total number of carbon atoms in these aliphatic monoamines preferably does not exceed about 40 and usually does not exceed about 20 carbon atoms. Specific examples of such monoamines include ethylamine, di-ethylamine, n-butylamine, di-n-butylamine, allylamine, isobutylamine, cocoamine, stearylamine, laurylamine, methyl-laurylamine, oleylamine, N-methyl-octylamine, dodecylamine, octadecylamine, and the like. Examples of cycloaliphatic-substituted aliphatic amines, aromatic-substituted aliphatic amines, and heterocyclic-substituted aliphatic amines, include 2-(cyclohexyl)-ethylamine, benzylamine, phenylethylamine, and 3-(furylpropyl)amine.

Examples of useful polyamines include N-aminopropylcyclohexylamine, N-N'-di-n-butyl-para-phenylene diamine, bis-(para-aminophenyl)-methane, 1,4-diaminocyclohexane, and the like.

Heterocyclic monoamines and polyamines can be used. As used herein, the terminology "heterocyclic mono- and polyamine(s)" is intended to describe those heterocyclic amines containing at least one primary or secondary amino group and at least one nitrogen as a heteroatom in the heterocyclic ring. These heterocyclic amines can be saturated or unsaturated and can contain various substituents such as nitro, alkoxy, alkyl mercapto, alkyl, alkenyl, aryl, alkaryl, or aralkyl substituents. Generally, the total number of carbon atoms in the substituents will not exceed about 20. Heterocyclic amines can contain more than one nitrogen heteroatom. The 5- and 6-membered heterocyclic rings are preferred.

Among the suitable heterocyclics are aziridines, azetidines, azolidines, tetra- and di-hydropyridines, pyrroles, indoles, piperadines, imidazoles, di- and tetra-hydroimidazoles, piperazines, isoindoles, purines, morpholines, thiomorpholines, N-aminoalkyl-morpholines, N-aminoalkylthiomorpholines, N-aminoalkyl-piperazines, N,N'-diaminoalkylpiperazines, azepines, azocines, azonines, azecines and tetra-, di- and perhydroderivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl-substituted piperidines, piperazine, aminoalkyl-substituted piperazines, morpholine, aminoalkyl-substituted morpholines, pyrrolidine, and aminoalkyl-substituted pyrrolidines, are useful. Usually the aminoalkyl substituents are substituted on a nitrogen atom forming part of the hetero ring. Specific examples of such heterocyclic amines include N-aminopropylmorpholine, N-aminoethylpiperazine, and N,N'-di-aminoethylpiperazine.

Also suitable as amines are the aminosulfonic acids and derivatives thereof corresponding to the formula:

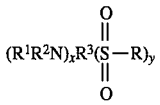

wherein R is OH, $NH_2$, $ONH_4$, etc.; $R^3$ is a polyvalent organic group having a valence equal to x+y; $R^1$ and $R^2$ are each independently hydrogen, hydrocarbyl or substituted hydrocarbyl with the proviso that at least one of $R^1$ and $R^2$ is hydrogen; x and y are each integers equal to or greater than one. Each aminosulfonic reactant is characterized by at least one HN< or $H_2N$— group and at least one

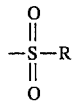

group. These sulfonic acids can be aliphatic, cycloaliphatic or aromatic aminosulfonic acids and the corresponding functional derivatives of the sulfo group. Specifically, the aminosulfonic acids can be aromatic aminosulfonic acids, that is, where $R^3$ is a polyvalent aromatic group such as phenylene where at least one

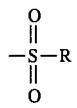

group is attached directly to a nuclear carbon atom of the aromatic group. The aminosulfonic acid may also be a mono-amino aliphatic sulfonic acid; that is, an acid where x is one and $R^3$ is a polyvalent aliphatic group such as ethylene, propylene, trimethylene, and 2-methylene propylene. Other suitable aminosulfonic acids and derivatives thereof useful as amines in this invention are disclosed in U.S. Pat. Nos. 3,029,250; 3,367,864; and 3,926,820; which are incorporated herein by reference.

The high molecular weight hydrocarbyl polyamines which can be used as amines in this invention are generally prepared by reacting a chlorinated polyolefin having a molecular weight of at least about 400 with ammonia or an amine. The amines that can be used are known in the art and described, for example, in U.S. Pat. Nos. 3,275,554 and 3,438,757, both of which are incorporated herein by reference. These amines must possess at least one primary or secondary amino group.

Another group of amines suitable for use in this invention are branched polyalkylene polyamines. The branched polyalkylene polyamines are polyalkylene polyamines wherein the branched group is a side chain containing on the average at least one-half nitrogen-bonded aminoalkylene

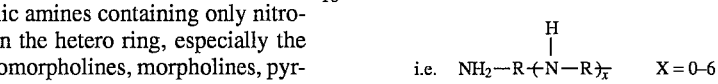

group per four to five amino units present on the main chain; for example, one of such branched chains per four units on the main chain. Thus, these polyamines contain at least three primary amino groups and at least one tertiary amino group. U.S. Pat. Nos. 3,200,106 and 3,259,578 are incorporated herein by reference for their disclosures relative to said polyamines.

Suitable amines also include polyoxyalkylene polyamines, e.g., polyoxyalkylene diamines and polyoxyalkylene triamines, having average molecular weights ranging from about 200 to about 4000, and in one embodiment from about 400 to 2000. Examples of these polyoxyalkylene polyamines include those amines represented by the formula:

$$NH_2\text{-Alkylene-}(\text{—O-Alkylene-})_m NH_2$$

wherein m has a value of from about 3 to about 70, and in one embodiment from about 10 to about 35; and the formula:

$$R\text{-}[\text{Alkylene-}(\text{—O-Alkylene-})_n NH_2]_{3\text{-}6}$$

wherein n is a number in the range of from 1 to about 40, with the proviso that the sum of all of the n's is from about 3 to about 70 and generally from about 6 to about 35, and R is a polyvalent saturated hydrocarbyl group of up to about 10 carbon atoms having a valence of from about 3 to about 6. The alkylene groups may be straight or branched and contain from 1 to about 7 carbon atoms, and usually from 1 to about 4 carbon atoms. The various alkylene groups present within the above formulae may be the same or different.

Useful polyoxyalkylene polyamines include the polyoxyethylene and polyoxypropylene diamines and the polyoxypropylene triamines having average molecular weights ranging from about 200 to about 2000. The polyoxyalkylene polyamines are commercially available from the Jefferson Chemical Company, Inc. under the trade name "Jeffamine." U.S. Pat. Nos. 3,804,763 and 3,948,800 are incorporated herein by reference for their disclosure of such polyoxyalkylene polyamines.

Useful amines are the alkylene polyamines conforming to the formula:

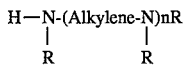

wherein n is from 1 to about 10; each R is independently a hydrogen atom, a hydrocarbyl group or a hydroxy-substituted hydrocarbyl group having up to about 700 carbon atoms, and in one embodiment up to about 100 carbon atoms, and in one embodiment up to about 30 carbon atoms; and the "Alkylene" group has from about 1 to about 10 carbon atoms with the preferred alkylene being ethylene or propylene. Useful are the alkylene polyamines wherein each R is hydrogen with the ethylene polyamines, and mixtures of ethylene polyamines being particularly preferred. Usually n will have an average value of from about 2 to about 7. Such alkylene polyamines include methylene polyamines, ethylene polyamines, butylene polyamines, propylene polyamines, pentylene polyamines, hexylene polyamines, heptylene polyamines, etc. The higher homologs of such amines and related aminoalkyl-substituted piperazines are also included.

Alkylene polyamines that are useful include ethylene diamine, triethylene tetramine, propylene diamine, trimethylene diamine, hexamethylene diamine, decamethylene diamine, octamethylene diamine, di(heptamethylene)triamine, tripropylene tetramine, tetraethylene pentamine, trimethylene diamine, pentaethylene hexamine, di(trimethylene)triamine, N-(2-aminoethyl)piperazine, 1,4-bis(2-aminoethyl)piperazine, and the like. Higher homologs as are obtained by condensing two or more of the above-illustrated alkylene amines are useful as amines in this invention as are mixtures of two or more of any of the afore-described polyamines.

Ethylene polyamines, such as those mentioned above, are described in detail under the heading "Diamines and Higher Amines" in The Encyclopedia of Chemical Technology, Second Edition, Kirk and Othmer, Volume 7, pages 27–39, Interscience Publishers, Division of John Wiley and Sons, 1965, these pages being incorporated herein by reference. Such compounds are prepared most conveniently by the reaction of an alkylene chloride with ammonia or by reaction of an ethylene imine with a ring-opening reagent such as ammonia, etc. These reactions result in the production of the somewhat complex mixtures of alkylene polyamines, including cyclic condensation products such as piperazines.

A useful class of polyamines that can be used are those represented by the formula $$H-\underset{\underset{R}{|}}{N}-(Z-NR')_x-R$$

in which each R is hydrogen or a hydrocarbyl group; each R' is independently hydrogen, alkyl, or $NH_2R''$ (NHR")y— where each R" is independently an alkylene group of 1 to about 10 carbon atoms and y is a number in the range of from 0 to about 6; each Z is independently an alkylene group of 1 to about 10 carbon atoms, a heterocyclic nitrogen containing cycloalkylene or an oxyalkylene group of 1 to about 10 carbon atoms and x is a number in the range of from 1 to about 10.

Polyamine Bottoms Useful as Polyamines (A)(II)(b) or in Making Condensed Polyamines (A)(II)(c).

The polyamine bottoms that can be used as either the polyamines (A)(II)(b) or in making the condensed polyamines (A)(II)(c) are polyamine mixtures resulting from stripping of the alkylene polyamine mixtures discussed above. Lower molecular weight polyamines and volatile contaminates are removed from an alkylene polyamine mixture to leave as residue what is often termed "polyamine bottoms." In general, alkylene polyamine bottoms can be characterized as having less than 2%, usually less than 1% by weight, material boiling below about 200° C. In the instance of ethylene polyamine bottoms, the bottoms contain less than about 2% by weight total diethylene triamine (DETA) or triethylene tetramine (TETA). A typical sample of such ethylene polyamine bottoms obtained from the Dow Chemical Company of Freeport, Tex. designated "E-100" showed a specific gravity at 15.6° C. of 1.0168, a percent nitrogen by weight of 33.15 and a viscosity at 40° C. of 121 centistokes. Gas chromatography analysis of such a sample showed it to contain about 0.93% "Light Ends" (DETA), 0.72% TETA, 21.74% tetraethylene pentamine and 76.61% pentaethylene hexamine and higher (by weight). These alkylene polyamine bottoms include cyclic condensation products such as piperazine and higher analogs of diethylene triamine, triethylene tetramine and the like.

Process for Making the Condensed Polyamines (A)(II)(a) and (A)(II)(c).

The reaction between the hydroxy material and the amine to form the condensed polyamines (A)(II)(a) and (A)(II)(c) requires the presence of an acid catalyst. The catalysts that are useful include mineral acids (mono, di- and polybasic acids) such as sulfuric acid and phosphoric acid; organo phosphorus acids and organo sulfonic acids such as $RP(O)(OH)_2$ and $RSO_3H$, wherein R is hydrocarbyl; alkali metal partial salts of $H_3PO_4$ and $H_2SO_4$, such as $NaHSO_4$, $LiHSO_4$, $KHSO_4$, $NaH_2PO_4$, $LiH_2PO_4$ and $KH_2PO_4$; alkaline earth metal partial salts of $H_3PO_4$ and $H_2SO_4$, such as $CaHPO_4$, $CaSO_4$ and Mg $HPO_4$; also $Al_2O_3$ and Zeolites. Phosphoric acid is useful because of its commercial availability and ease of handling. Also useful as catalysts for this invention are materials which generate acids when treated in the reaction mixture, e.g., triphenylphosphite.

The reaction is run at an elevated temperature which, depending upon the particular reactants, can range from about 60° C. to about 265° C. Most reactions, however, are run in the range of about 220° C. to about 250° C. The reaction may be run at atmospheric pressure or optionally at a reduced pressure depending upon the particular reactants. The degree of condensation of the resultant polyamine is limited only to the extent necessary to prevent the formation of solid products under reaction conditions. The control of the degree of condensation of the product is normally accomplished by limiting the amount of the condensing agent, i.e., the hydroxy material, charged to the reaction medium. In one embodiment, the condensed polyamines are pourable at room temperature and have viscosities which range from about 100% greater than the viscosity of the amine reactant to about 6000% greater than the viscosity of the amine reactant. In one embodiment, the condensed polyamines have viscosities which range from about 50% to about 1000% greater than the viscosity of the amine reactant. In one embodiment, the viscosity of the condensed polyamines ranges from about 50 cSt to about 200 cSt at 100° C.

Process for Making the Acylated Amine (A).

The carboxylic acid acylating agents (A)(I) can be reacted with the polyamines (A)(II) according to conventional amide, imide or amidene forming techniques to form the acylated amines (A). This normally involves heating the acylating agent (A) with the polyamine (A)(II), optionally in the presence of a normally liquid, substantially inert, organic liquid solvent/diluent. Temperatures of at least about 30° C. up to the decomposition temperature of the reaction component and/or product having the lowest such temperature can be used. This temperature usually is in the range of about 80° C. to about 250° C.

The relative proportions of the acylating agent (A)(I) and the polyamine (A)(II) to be used in the above process are such that at least about one-half of a stoichiometrically equivalent amount of the polyamine (A)(II) is used for each equivalent of the acylating agent (A)(I) used. In this regard it will be noted that the equivalent weight of the polyamine (A)(II) is based upon the number of the nitrogen-containing as determined by the percent nitrogen in the polyamine. At least one non-tertiary nitrogen per mole of amine as characterized by

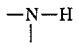

is required for the polyamine to be reactive. Similarly the equivalent weight of the acylating agent (A)(I) is based upon the number of the acid-producing groups defined by the structural configuration

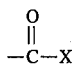

where X=

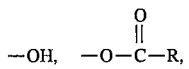

or, halogen. Thus, ethylene diamine has two equivalents per mole; amino guanidine has four equivalents per mole; a succinic acid or ester has two equivalents per mole, etc. The upper limit of the useful amount of the polyamine (A)(II) appears to be about two moles for each equivalent of the acylating agent (A)(I) used. Such amount is required, for instance, in the formation of products having predominantly amidine linkages. Beyond this limit, the excess amount of the polyamine (A)(II) appears not to take part in the reaction. On the other hand, the lower limit of about one-half equivalent of the polyamine (A)(II) used for each equivalent of the acylating agent (A)(I) is based upon the stoichiometry for the formation of products having predominantly imide linkages. In most instances, the amount of the polyamine (A)(II) is at least one equivalent for each equivalent of the acylating agent (A)(I) used.

In one embodiment, the acylated amines (A) are prepared in the same manner as the polyamines (A)(II) of the present invention. That is, they are prepared by the acid catalyzed condensation reaction of at least one carboxylic acylating agent (A)(I) with at least one polyamine (A)(II). The catalysts previously described with respect to the polyamines (A)(II) are useful in this reaction.

The following examples are illustrative of the preparation of acylated amines (A) that are useful with this invention. In the following example, as well as throughout the specification and in the claims, unless otherwise indicated, all parts and percentages are by weight, all temperatures are in degrees Celsius, and all pressures are at or near atmospheric.

EXAMPLE A-1

Part I

A mixture of 76.4 parts by weight of HPA-X (a product of Union Carbide identified as a polyamine bottoms product having a nitrogen content of 31.5% by weight and an average base number of 1180) and 46.7 parts by weight of THAM (trishydroxymethyl aminomethane) are heated at a temperature of 220° C. under condensation reaction conditions in the presence of 1.25 parts by weight of an 85% by weight phosphoric acid aqueous solution to form a condensed polyamine. 1.7 parts by weight a 50% aqueous solution of NaOH are then added to the reaction mixture to neutralize the phosphoric acid. The resulting product is a condensed polyamine having the following properties: viscosity at 40° C. of 6500 cSt; viscosity at 100° C. of 90 cSt; total base number of 730; and nitrogen content of 27% by weight.

Part II

A mixture of 1000 parts by weight of polyisobutenyl (Mn=1000) succinic anhydride and 400 parts by weight of diluent oil are charged to a reactor while mixing under a $N_2$ purge. The batch temperature is adjusted to 88° C. 152 parts by weight of the condensed polyamine from Part I are charged to the reactor while maintaining the reactor temperature at 88°–93° C. The molar ratio of acid to nitrogen is 1 COOH: 1.55N. The batch is mixed for two hours at 82°–96° C., then heated to 152° C. over 5.5 hours. The $N_2$ purge is discontinued and submerged $N_2$ blowing is begun. The batch is blown to a water content of 0.30% by weight or less at 149°–154° C., cooled to 138°–149° C. and filtered. Diluent oil is added to provide an oil content of 40% by weight. The resulting product has a nitrogen content of 2.15% by weight, a viscosity at 100° C. of 210 cSt, and a total base number of 48.

EXAMPLE A-2

A mixture of 108 parts by weight of a polyamine mixture (15% by weight diethylene triamine and 85% by weight polyamine bottoms) and 698 parts by weight diluent oil is charged to a reactor. 1000 parts by weight of polyisobutenyl (Mn=1000) succinic anhydride are charged to the reactor under a $N_2$ purge while maintaining the batch temperature at 110°–121° C. The molar ratio of acid to nitrogen is 1 COOH: 1.5N. After neutralization submerged $N_2$ blowing is begun. The batch is heated to 143°–149° C., and then filtered. Diluent oil is added to provide an oil content of 40% by weight. The resulting product has a nitrogen content of 2.0% by weight, a viscosity at 100° C. of 135–155 cSt, and a total base number of 55.

(B) Boron Compound.

The boron compound can be an inorganic or an organic compound. The inorganic compounds include the boron acids, anhydrides, oxides and halides. The organic boron compounds include the boron amides and esters. Also included are the borated acylated amines, borated epoxides and the borated fatty acid esters of glycerol.

The boron compounds that are useful include boron oxide, boron oxide hydrate, boron trioxide, boron trifluoride, boron tribromide, boron trichloride, boron acids such as boronic acid (i.e., alkyl-$B(OH)_2$ or aryl-$B(OH)_2$), boric acid (i.e., $H_3BO_3$), tetraboric acid (i.e., $H_2B_4O_7$), metaboric acid (i.e., $HBO_2$), boron anhydrides, boron amides and various esters of such boron acids. Complexes of boron trihalide with ethers, organic acids, inorganic acids, or hydrocarbons can be used. Examples of such complexes include boron-trifluoride-triethyl ester, boron trifluoride-phosphoric acid, boron trichloride-chloroacetic acid, boron tribromide-dioxane, and boron trifluoridemethyl ethyl ether.

Specific examples of boronic acids include methyl boronic acid, phenylboronic acid, cyclohexyl boronic acid, p-heptylphenyl boronic acid and dodecyl boronic acid.

The boron acid esters include mono-, di-, and tri-organic esters of boric acid with alcohols or phenols such as, e.g., methanol, ethanol, isopropanol, cyclohexanol, cyclopentanol, 1-octanol, 2-octanol, dodecanol, behenyl alcohol, oleyl alcohol, stearyl alcohol, benzyl alcohol, 2-butyl cyclohexanol, ethylene glycol, propylene glycol, trimethylene glycol, 1,3-butanediol, 2,4-hexanediol, 1,2-cyclohexanediol, 1,3-octanediol, glycerol, pentaerythritol diethylene glycol, carbitol, Cellosolve, triethylene glycol, tripropylene glycol, phenol, naphthol, p-butylphenol, o,p-diheptylphenol, n-cyclohexylphenol, 2,2-bis-(p-hydroxyphenyl)-propane, polyisobutene (molecular weight of 1500)-substituted phenol, ethylene chlorohydrin, o-chlorophenol, m-nitrophenol, 6-bromooctanol, and 7-keto-decanol. Lower alcohols, 1,2-glycols, and 1-3-glycols, i.e., those having less than about 8 carbon atoms are especially useful for preparing the boric acid esters for the purpose of this invention.

Methods for preparing the esters of boron acid are known and disclosed in the art (such as "Chemical Reviews," pp. 959–1064, Vol. 56). Thus, one method involves the reaction of boron trichloride with 3 moles of an alcohol or a phenol to result in a tri-organic borate. Another method involves the reaction of boric oxide with an alcohol or a phenol. Another method involves the direct esterification of tetra boric acid with 3 moles of an alcohol or a phenol. Still another method involves the direct esterification of boric acid with a glycol to form, e.g., a cyclic alkylene borate.

Borated Acylated Amines.

The borated acylated amines can be prepared by first reacting a carboxylic acid acylating agent with at least about one-half equivalent, per equivalent of carboxylic acid acylating agent, of an amine containing at least one hydrogen attached to a nitrogen group. The acylated amine obtained in this manner is usually a complex mixture of acylated amines. The acylated amine is then borated by reacting it with a boron compound of the type described above, including the boron trioxides, boron halides, boron acids, boron amides, and esters of boron acids.

The acylated amines that can be used are described above under the subtitle "(A) Acylated Amines". Additional acylated amines that can be used are described in the following U.S. patents:

| | | |
|---|---|---|
| 3,172,892 | 3,341,542 | 3,630,904 |
| 3,215,707 | 3,346,493 | 3,632,511 |
| 3,272,746 | 3,444,170 | 3,787,374 |
| 3,316,177 | 3,454,607 | 4,234,435 |
| 3,541,012 | | |

The above U.S. patents are expressly incorporated herein by reference for their teaching of the preparation of acylated amines that are useful herein.

The amount of boron compound reacted with the acylated amine intermediate generally is sufficient to provide from about 0.1 atomic proportion of boron for each mole of the acylated amine up to about 10 atomic proportions of boron for each atomic proportion of nitrogen of said acylated amine. More generally the amount of boron compound present is sufficient to provide from about 0.5 equivalents of boron for each equivalent of the acylated amine to about 2 equivalents of boron for each equivalent proportion of nitrogen used.

The reaction of the acylated amine with the boron compound can be effected simply by mixing the reactants at the desired temperature. The use of an inert solvent is optional although it is often desirable, especially when a highly viscous or solid reactant is present in the reaction mixture. The inert solvent may be a hydrocarbon such as benzene, toluene, naphtha, cyclohexane, n-hexane, or mineral oil. The temperature of the reaction may be varied within wide ranges. Ordinarily it is preferably between about 50° C. and about 250° C. In some instances it may be 25° C. or even lower. The upper limit of the temperature is the decomposition point of the particular reaction mixture and/or product.

The reaction is usually complete within a short period such as 0.5 to 6 hours. After the reaction is complete, the product may be dissolved in the solvent and the resulting solution purified by centrifugation or filtration if it appears to be hazy or contain insoluble substances. Ordinarily the product is sufficiently pure so that further purification is unnecessary or optional.

Borated Epoxides.

The borated epoxides are made by reacting at least one of boric acid or boron trioxide with at least one epoxide having the formula

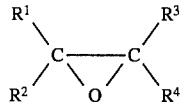

wherein each of $R^1$, $R^2$, $R^3$ and $R^4$ is hydrogen or an aliphatic group, or any two thereof together with the epoxy carbon atom or atoms to which they are attached form a cyclic group. The epoxide contains at least 8 carbon atoms. In one embodiment this reaction is conducted in the presence of a minor amount of a heel of a previously obtained oil-soluble boron-containing composition prepared by reacting the foregoing reagents.

The boric acid that can be used can be any of the various forms of boric acid, including metaboric acid ($HBO_2$), orthoboric acid ($H_3BO_3$) and tetraboric acid ($H_2B_4O_7$). Boric acid and orthoboric acid are preferred.

Each of the R groups in the above formula are most often hydrogen or an aliphatic group with at least one being an aliphatic group containing at least 6 carbon atoms. The term "aliphatic group" includes aliphatic hydrocarbon groups (e.g., hexyl, heptyl, octyl, decyl, dodecyl, tetradecyl, stearyl, hexenyl, oleyl), preferably free from acetylenic unsaturation; substituted aliphatic hydrocarbon groups including substituents such as hydroxy, nitro, carbalkoxy, alkoxy and alkylthio (especially those containing a lower alkyl group; i.e., one containing 7 carbon atoms or less); and hetero atom-containing groups in which the hetero atoms may be, for example, oxygen, nitrogen or sulfur. The aliphatic groups are generally alkyl groups, and in one embodiment those containing from about 10 to about 20 carbon atoms. It is within the scope of the invention to use commercial mixtures of epoxides; for example, commercial mixtures of $C_{14-16}$ or $C_{14-18}$ epoxides and the like, wherein $R^1$ is a mixture of alkyl radicals having two less carbon atoms than the epoxide.

In one embodiment the borated epoxide is a borated alpha-olefin epoxide having about 10 to about 20 carbon atoms, and in one embodiment about 14 to about 18 carbon atoms.

Also within the scope of the invention is the use of epoxides in which any two of the R groups together with the epoxy carbon atom or atoms to which they are attached, form a cyclic group, which may be alicydic or heterocyclic. Examples include n-butylcyclopentene oxide, n-hexylcyclohexene oxide, methylenecyclooctene oxide and 2-methylene-3-n-hexyltetrahydrofuran oxide.

The borated epoxides may be prepared by merely blending the boric acid or boron trioxide and the epoxide and heating them at a temperature from about 80° C. to about 250° C., and in one embodiment from about 100° C. to about 200° C., for a period of time sufficient for reaction to take place. If desired, the reaction may be effected in the presence of a substantially inert, normally liquid organic diluent such as toluene, xylene, chlorobenzene, dimethylformamide or the like, but such diluents are usually unnecessary. During the reaction, water is frequently evolved and may be removed by distillation.

The molar ratio of the boric acid or boron trioxide to the epoxide is generally between about 1:0.25 and about 1:4. Ratios between about 1:1 and about 1:3 are especially useful.

In one embodiment it is advantageous to employ a catalytic amount of an alkaline reagent to facilitate the reaction.

Suitable alkaline reagents include inorganic bases and basic salts such as sodium hydroxide, potassium hydroxide and sodium carbonate; metal alkoxides such as sodium methoxide, potassium t-butoxide and calcium ethoxide; heterocyclic amines such as piperidine, morpholine and pyridine; and aliphatic amines such as n-butylamine, di-n-hexylamine and tri-n-butylamine. Useful alkaline reagents are the aliphatic and heterocyclic amines and especially tertiary amines.

The preparation of a borated epoxide useful in this invention is illustrated by the following example.

EXAMPLE B-1

Part I:

A mixture of 1500 parts (6.25 moles) of 1-hexadecene oxide and 1 part of tri-n-butylamine is heated to 100°–110° C. under nitrogen, with stirring. Boric acid, 193 parts (3.13 moles), is added incrementally over 15 minutes. When boric acid addition is complete, the reaction mixture is heated to 185° C. as water is removed by distillation. When water evolution ceases, the mixture is filtered while hot, and the filtrate is allowed to cool to a waxy solid melting at 60°–65° C. This solid is the desired product; it contains 2.7% boron.

Part II:

A blend of 193 parts (3.13 moles) of boric acid, 1 part of tri-n-butylamine and a "heel" comprising 402 parts of the product prepared as in Part I is heated to 188° C., with stirring, as volatiles are removed by distillation. After 8.5 hours, 1500 parts (6.25 moles) of 1-hexadecene oxide is added over 5.5 hours at 186°–195° C., with stirring. Heating and stirring are continued for 2 hours as volatiles are removed. The material is then vacuum stripped and filtered at 93°–99° C. The filtrate is the desired product; it contains 2.1% boron.

Borated Fatty Acid Esters of Glycerol.

The borated partial fatty acid esters of glycerol are prepared by reacting a fatty acid ester of glycerol with a boric acid (e.g., boric acid, metaboric acid, orthoboric acid, tetraboric acid) with removal of the water of reaction. In one embodiment there is sufficient boron present such that each boron will react with from about 1.5 to about 2.5 hydroxyl groups present in the reaction mixture.

The reaction may be carded out at a temperature in the range of about 60° C. to about 135° C., in the absence or presence of any suitable organic solvent such as methanol, benzene, xylenes, toluene, neutral oil and the like.

Fatty acid esters of glycerol can be prepared by a variety of methods well known in the art. Many of these esters, such as glycerol monooleate and glycerol monotallowate, are manufactured on a commercial scale. The esters useful for this invention are oil-soluble and are preferably prepared from $C_8$ to $C_{22}$ fatty acids or mixtures thereof such as are found in natural products. The fatty acid may be saturated or unsaturated. Certain compounds found in acids from natural sources may include licanic acid which contains one keto group. Useful $C_8$ to $C_{22}$ fatty acids are those of the formula R—COOH wherein R is alkyl or alkenyl.

The fatty acid monoester of glycerol is useful. Mixtures of mono and diesters may be used. Mixtures of mono- and diester can contain at least about 40% of the monoester. Mixtures of mono- and diesters of glycerol containing from about 40% to about 60% by weight of the monoester can be used. For example, commercial glycerol monooleate containing a mixture of from 45% to 55% by weight monoester and from 55% to 45% diester can be used.

Useful fatty acids are oleic, stearic, isostearic, palmitic, myristic, palmitoleic, linoleic, lauric, linolenic, and eleostearic, and the acids from the natural products such as tallow, palm oil, olive oil, peanut oil, corn oil, neat's foot oil and the like.

Useful borated fatty acid esters of glycerol include borated glycerol monooleate, borated lecithin, borated monotallowate.

Borated Alkoxylated Fatty Amines

Representative examples of the tertiary amine compounds useful in preparing the organo-borate compounds of this invention include borated di(hydroxyethyl)tallow amine, monoalkoxylated amines such as dimethylethanolamine, diethylethanolamine, dibutylethanolamine, diisopropylethanolamine, di(2-ethylhexyl)ethanolamine, phenylethylethanolamine, and the like and polyalkoxylated amines such as methyldiethanolamine, ethyldiethanolamine, phenyldiethanolamine, diethyleneglycol mono-N-morpholinoethyl ether, N-(2-hydroxyethyl)thiazolidine, 3-morpholinopropyl-( 2-hydroxyethyl)cocoamine, N-(2-hydroxy-ethyl)-N-tallow-3-aminomethylpropionate, 2-oleoylethyl(2-hydroxyethyl-)tallowamine, N'-[2-hydroxy-ethylaminoethyl]thiazole, 2-methoxyethyl-( 2-hydroxyethyl)tallowamine, 1-[N-dodecenyl; N-2-hydroxyethylaminoethyl]imidazole, N-N'-octadecenyl-N'-2-hydroxyethyl-aminoethyl]phenothiazine, 2-hydroxydicocamine, 2-heptadecenyl-1-(2-hydroxyethylimidazoline, 2-dodecyl-1-(5-hydroxypentyl-imidazoline, 2-(3-cyclohexyl propyl)-1-(2-hydroxyethyl-imidazoline) and the like.

An especially preferred class of tertiary amines useful in preparing the organo-borate compounds of the invention is that constituting the commercial alkoxylated fatty amines known by the trademark "ETHOMEEN" and available from the Armak Company. Representative examples of these ETHOMEENs are ETHOMEEN C/12(bis[2-hydroxyethyl] cocoamine); ETHOMEEN C/20 (polyoxyethylene[10]cocoamine); ETHOMEEN S/12(bis[2-hydroxyethyl] soyamine); ETHOMEEN T/12(bis[2-hydroxyethyl] tallowamine); ETHOMEEN T/15(polyoxyethylene-[5] tallowamine); ETHOMEEN O/12(bis[2-hydroxyethyl] oleyl-amine; ETHOMEEN 18/12(bis[2-hydroxyethyl] octadecylamine); ETHOMEEN 18/25 polyoxyethylene[15] octadecylamine and the like. Of the various ETHOMEEN compounds useful in repairing the organoborate additive compounds of the invention, ETHOMEEN T/12 is most preferred. Fatty amines, as well as being commercially available are also described in U.S. Pat. No. 4,741,848 which is hereby incorporated by reference herein.

If desired, the tertiary amine reactants represented by formulae (A) and (B) above may be reacted first with elemental sulfur to sulfurize any carbon-to-carbon double bond unsaturation which may be present in the hydrocarbon based radicals $R^2$, $R^3$ and $R^5$ when these radicals are, for example, alkenyl radicals (e.g., fatty oil or fatty acid radicals). Generally, the sulfurization reaction will be carried out at temperatures ranging from about 100° C. to about 250° C., and preferably from about 150° C. to about 200° C. The molar ratio of sulfur to amine can range from about 0.5:1.0 to about 3:0:1.0 and preferably 1:0:1.0. Although, generally no catalyst is required to promote sulfurization of any carbon-to-carbon double bond unsaturation which may be present in any tertiary amine reactant useful in preparing the organo-borate compositions of this invention, catalysts may be employed if desired. If such catalysts are employed, preferably such catalysts are tertiary hydrocarbon substituted amines, most preferably, trialkylamines. Representative examples of trialkylamines include tributylamine, dimethyloctylamine, triethylamine and the like.

The organo-borate additive friction modifiers can be prepared by adding the boron reactant, preferably boric acid, to at least one of the above-defined tertiary amine reactants, in a suitable reaction vessel, and heating the resulting reaction mixture at a temperature ranging from about 50° to about 300° C. with continuous stirring. The reaction is continued until by-product water ceases to evolve from the reaction mixture indicating completion of the reaction. The removal of by-product water is facilitated by either blowing an inert gas, such as nitrogen, over the surface of the reaction mixture or by conducting the reaction at reduced pressures. Preferably the reaction between the boron reactant and the tertiary amine will be carried out at temperatures ranging from about 100° C. to about 250° C. and most preferably between about 150° C. and 230° C. while blowing with nitrogen.

Although normally the amines will be liquid at room temperature, in those instances where the amine reactant is a solid or semi-solid, it will be necessary to heat the amine to above its melting point in order to liquify it prior to the addition of the boron-containing reactant thereto. Those of ordinary skill in the art can readily determine the melting point of the amine either from the general literature or through a simple melting point analysis.

Generally, the amine reactant alone will serve as the solvent for the reaction mixture of the boron-containing reactant and amine reactant. However, if desired, an inert normally liquid organic solvent can be used such as mineral oil, naphtha, benzene, toluene or xylene can be used as the reaction media. Where the organo-borate additive compound is to be added directly to a lubricating oil, it is generally preferred to conduct the reaction merely using the amine reactant as the sole solvent.

The alkoxylated fatty amines, and fatty amines themselves are generally useful as components of this invention. Both types of amines are commercially available.

(C) Organic Phosphorus Acid, Ester or Derivative.

The organic phosphorus acid, ester or derivative (C) can be an organic phosphorus acid, organic phosphorus acid ester, organic phosphorus acid salt, or derivative thereof. The organic phosphorus acids include the phosphonic, phosphinic, thiophosphoric, thiophosphinic and thiophosphonic acids.

The phosphorus acids can be represented by the formula

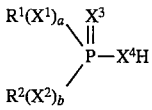

(C-I)

wherein $X^1$, $X^2$, $X^3$ and $X^4$ are independently O or S, and $X^1$ and $X^2$ can be $NR^3$ wherein $R^3$ is hydrogen or a hydrocarbyl group, preferably hydrogen or a lower alkyl group; a and b are independently zero or one, and $R^1$ and $R^2$ are independently hydrocarbyl groups. These phosphorus acids include the phosphorus- and sulfur-containing acids. They include those acids wherein at least one $X^3$ or $X^4$ is sulfur, and more preferably both $X^3$ and $X^4$ are sulfur, at least one $X^1$ or $X^2$ is oxygen or sulfur, more preferably both $X^1$ and $X^2$ are oxygen, and a and b are each 1.

The phosphorus acids can be at least one phosphate, phosphonate, phosphinate or phosphine oxide. These pentavalent phosphorus derivatives can be represented by the formula

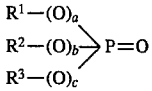

(C-II)

wherein $R^1$, $R^2$ and $R^3$ are independently hydrogen or hydrocarbyl groups, with the proviso that at least one of $R^1$, $R^2$ or $R^3$ is hydrocarbyl, and a, b and c are independently zero or 1.

The phosphorus acid can be at least one phosphite, phosphonite, phosphinite or phosphine. These trivalent phosphorus derivatives can be represented by the formula

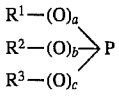

(C-III)

wherein $R^1$, $R^2$ and $R^3$ are independently hydrogen or hydrocarbyl groups, with the proviso that at least one of $R^1$, $R^2$ or $R^3$ is hydrocarbyl, and a, b and c are independently zero or 1.

The total number of carbon atoms in the R groups in each of the above formulae (C-I), (C-II) and (C-III) must be sufficient to render the compound oil-soluble. Generally, the total number of carbon atoms in the R groups is at least about 8, and in one embodiment at least about 12, and in one embodiment at least about 16. There is no limit to the total number of carbon atoms in the R groups that is required, but a practical upper limit is about 400 or about 500 carbon atoms. In one embodiment, each of the R groups in the above formulae are independently hydrogen or hydrocarbyl groups of 1 to about 100 carbon atoms, or 1 to about 50 carbon atoms, or 1 to about 30 carbon atoms, with the proviso that at least one of the R groups is hydrocarbyl and the total number of carbons is at least about 8. Each of the R groups can be the same as the other, although they may be different. Examples of useful R groups include t-butyl, isobutyl, amyl, isooctyl, decyl, dodecyl, eicosyl, 2-pentenyl, dodecenyl, phenyl, naphthyl, alkylphenyl, alkylnaphthyl, phenylalkyl, naphthylalkyl, alkylphenylalkyl, alkylnaphthylalkyl, and the like.

The phosphorus acid esters can be prepared by reacting a phosphorus acid or anhydride with an alcohol containing from 1 or about 3 carbon atoms up to about 30, or about 24, or about 12 carbon atoms. The phosphorus acid or anhydride is generally an inorganic phosphorus reagent such as phosphorus pentoxide, phosphorus trioxide, phosphorus tetraoxide, phosphorus acid, phosphorus halide, or lower phosphorus esters, and the like. Lower phosphorus acid esters contain from 1 to about 7 carbon atoms in each ester group. The phosphorus acid ester may be a mono, di- or triphosphoric acid ester.

Alcohols used to prepare the phosphorus acid esters include butyl, amyl, hexyl, octyl, oleyl, and cresol alcohols. Higher synthetic monohydric alcohols of the type formed by Oxo process (e.g., 2-ethylhexyl), the Aldol condensation, or by organo aluminum catalyzed oligomerization of alpha-olefins (especially ethylene), followed by oxidation and hydrolysis, also are useful. Examples of some preferred monohydric alcohols and alcohol mixtures include the commercially available "Alfol" alcohols marketed by Continental Oil Corporation. Alfol 810 is a mixture of alcohols containing primarily straight chain, primary alcohols having from 8 to 10 carbon atoms. Alfol 12 is a mixture of alcohols containing mostly $C_{12}$ fatty alcohols. Alfol 1218 is a mixture of synthetic, primary, straight-chain alcohols containing primarily 12 to 18 carbon atoms. The Alfol 20+ alcohols are mixtures of $C_{18}$–$C_{28}$ primary alcohols having mostly, on an alcohol basis, $C_{20}$ alcohols as determined by GLC (gas-liquid-chromatography). The Alfol 22+ alcohols are $C_{18}$–$C_{28}$ primary alcohols containing primarily, on an alcohol basis, $C_{22}$ alcohols. These Alfol alcohols can contain a fairly large percentage (up to 40% by weight) of paraffinic compounds which can be removed before the reaction if desired.

Another example of a commercially available alcohol mixture is Adol 60 which comprises about 75% by weight of a straight chain $C_{22}$ primary alcohol, about 15% of a $C_{20}$ primary alcohol and about 8% of $C_{18}$ and $C_{24}$ alcohols. Adol 320 comprises predominantly oleyl alcohol. The Adol alcohols are marketed by Ashland Chemical.

A variety of mixtures of monohydric fatty alcohols derived from naturally occurring triglycerides and ranging in chain length of from $C_8$ to $C_{18}$ are available from Proctor & Gamble Company. These mixtures contain various amounts of fatty alcohols containing mainly 12, 14, 16, or 18 carbon atoms. For example, CO-1214 is a fatty alcohol mixture containing 0.5% of $C_{10}$ alcohol, 66.0% of $C_{12}$ alcohol, 26.0% of $C_{14}$ alcohol and 6.5% of $C_{16}$ alcohol.

Another group of commercially available mixtures include the "Neodol" products available from Shell Chemical Co. For example, Neodol 23 is a mixture of $C_{12}$ and $C_{13}$ alcohols; Neodol 25 is a mixture of $C_{12}$ and $C_{15}$ alcohols; and Neodol 45 is a mixture of $C_{14}$ to $C_{15}$ linear alcohols. Neodol 91 is a mixture of $C_9$, $C_{10}$ and $C_{11}$ alcohols.

Fatty vicinal diols also are useful and these include those available from Ashland Oil under the general trade designation Adol 114 and Adol 158. The former is derived from a straight chain alpha olefin fraction of $C_{11}$–$C_{14}$, and the latter is derived from a $C_{15}$–$C_{18}$ fraction.

Examples of useful phosphorus acid esters include the phosphoric acid esters prepared by reacting a phosphoric add or anhydride with cresol alcohols. An example is tricresyl phosphate.

In one embodiment, the phosphorus acid ester is a monothiophosphoric acid ester or a monothiophosphate. Monothiophosphates are prepared by the reaction of a sulfur source and a dihydrocarbyl phosphite. The sulfur source may be elemental sulfur, a monosulfide, such as a sulfur coupled olefin or a sulfur coupled dithiophosphate. Elemental sulfur is a preferred sulfur source. The preparation of monothiophosphates is disclosed in U.S. Pat. No 4,755,311 and PCT Publication WO 87/07638 which are incorporated herein by reference for their disclosure of monothiophosphates, sulfur sources for preparing monothiophosphates and the process for making monothiophosphates.

In one embodiment, the phosphorus acid is a dithiophosphoric acid or phosphorodithioic acid. The dithiophosphoric acid can be reacted with an epoxide or a glycol to form an intermediate. The intermediate is then reacted with a phosphorus acid, anhydride, or lower ester. The epoxide is generally an aliphatic epoxide or a styrene oxide. Examples of useful epoxides include ethylene oxide, propylene oxide, butene oxide, octene oxide, dodecane oxide, styrene oxide, etc. Propylene oxide is preferred. The glycols may be aliphatic glycols having from 1 to about 12, preferably about 2 to about 6, more preferably 2 or 3 carbon atoms, or aromatic glycols. Aliphatic glycols include ethylene glycol, propylene glycol, triethylene glycol and the like. Aromatic glycols include hydroquinone, catechol, resorcinol, and the like. These are described in U.S. Pat. No. 3,197,405 which is incorporated herein by reference for its disclosure of dithiophosphoric acids, glycols, epoxides, inorganic phosphorus reagents and methods of reacting the same.

When the phosphorus acid esters are acidic, they may be reacted with an amine compound or metallic base to form the corresponding amine or metal salt. The salts may be formed separately and then the salt of the phosphorus acid ester is added to the lubricant or functional fluid composition. Alternatively, the salts may also be formed when the phosphorus acid ester is blended with other components to form the lubricating composition. The phosphorus acid ester could then form salts with basic materials which are in the lubricant or functional fluid composition such as basic nitrogen containing compounds (e.g., carboxylic dispersants) and overbased materials.

The amine salts of the phosphorus acid esters may be formed from ammonia, or a primary, secondary or tertiary amine, or mixtures thereof. These amines can be monoamines or polyamines. Useful amines include those amines discussed above under the headings "(A)(II) Polyamines." Also useful are the amines disclosed in U.S. Pat. No. 4,234,435 at Col. 1, line 4, to Col. 27, line 50; these pages being incorporated herein by reference.

The metal salts of the phosphorus acid esters are prepared by the reaction of a metal base with the phosphorus acid ester. The metal base may be in any convenient form such as oxide, hydroxide, carbonate, borate, or the like. The metals of the metal base include Group IA, IIA, IB through VIIB and VIII metals (CAS version of the Periodic Table of the Elements). These metals include the alkali metals, alkaline earth metals and transition metals. In one embodiment, the metal is a Group IIA metal such as calcium or magnesium, Group IIB metal such as zinc, or a Group VIIB metal such as manganese. In one embodiment the metal is magnesium, calcium, manganese or zinc.

The phosphorous acid ester can be a phosphite. In one embodiment, the phosphite is a di- or trihydrocarbyl phosphite. Each hydrocarbyl group can have from 1 to about 24 carbon atoms, or from 1 to about 18 carbon atoms, or from about 2 to about 8 carbon atoms. Each hydrocarbyl group may be independently alkyl, alkenyl or aryl. When the hydrocarbyl group is an aryl group, then it contains at least about 6 carbon atoms; and in one embodiment about 6 to about 18 carbon atoms. Examples of the alkyl or alkenyl groups include propyl, butyl, hexyl, heptyl, octyl, oleyl, linoleyl, stearyl, etc. Examples of aryl groups include phenyl, naphthyl, heptylphenol, etc. In one embodiment each hydrocarbyl group is independently propyl, butyl, pentyl, hexyl, heptyl, oleyl or phenyl, more preferably butyl, oleyl or phenyl and more preferably butyl or oleyl. Phosphites and their preparation are known and many phosphites are available commercially. Useful phosphites are dibutylhydrogen phosphite, trioleyl phosphite and triphenyl phosphite.

In one embodiment, the phosphorus acid derivative is a phosphorus-containing amide. The phosphorus-containing amides may be prepared by the reaction of a phosphorus acid (e.g., a dithiophosphoric acid as described above) with an unsaturated amide. Examples of unsaturated amides include acrylamide, N,N'-methylene bisacrylamide, methacrylamide, crotonamide, and the like. The reaction product of the phosphorus acid with the unsaturated amide may be further reacted with linking or coupling compounds, such as formaldehyde or paraformaldehyde to form coupled compounds. The phosphorus-containing amides are known in the art and are disclosed in U.S. Pat. Nos. 4,876,374, 4,770,807 and 4,670,169 which are incorporated by reference for their disclosures of phosphorus amides and their preparation.

In one embodiment, the phosphorous acid ester is a phosphorus-containing carboxylic ester. The phosphorus-containing carboxylic esters may be prepared by reaction of one of the above-described phosphorus acids, such as a dithiophosphoric acid, and an unsaturated carboxylic acid or ester, such as a vinyl or allyl acid or ester. If the carboxylic acid is used, the ester may then be formed by subsequent reaction with an alcohol.

The vinyl ester of a carboxylic acid may be represented by the formula $RCH{=}CH{-}O(O)CR^1$ wherein R is a hydrogen or hydrocarbyl group having from 1 to about 30 carbon atoms, preferably hydrogen or a hydrocarbyl group having 1 to about 12, more preferably hydrogen, and $R^1$ is a hydrocarbyl group having 1 to about 30 carbon atoms, or 1 to about 12, or 1 to about 8. Examples of vinyl esters include vinyl acetate, vinyl 2-ethylhexanoate, vinyl butanoate, and vinyl crotonate.

In one embodiment, the unsaturated carboxylic ester is an ester of an unsaturated carboxylic acid, such as maleic, fumaric, acrylic, methacrylic, itaconic, citraconic acids and the like. The ester can be represented by the formula RO—(O)CHC=CH—C(O)OR wherein each R is independently a hydrocarbyl group having 1 to about 18 carbon atoms, or 1 to about 12, or 1 to about 8 carbon atoms.

Examples of unsaturated carboxylic esters that are useful include methylacrylate, ethylacrylate, 2-ethylhexylacrylate, 2-hydroxyethylacrylate, ethylmethacrylate, 2-hydroxyethylmethacrylate, 2-hydroxypropylmethacrylate, 2-hydroxypropylacrylate, ethylmaleate, butylmaleate and 2-ethylhexylmaleate. The above list includes mono- as well as diesters of maleic, fumaric and citraconic acids.

In one embodiment, the phosphorous acid is the reaction product of a phosphorus acid and a vinyl ether. The vinyl ether is represented by the formula $R—CH_2=CHOR^1$ wherein R is hydrogen or a hydrocarbyl group having 1 to about 30, preferably 1 to about 24, more preferably 1 to about 12 carbon atoms, and $R^1$ is a hydrocarbyl group having 1 to about 30 carbon atoms, preferably 1 to about 24, more preferably 1 to about 12 carbon atoms. Examples of vinyl ethers include vinyl methylether, vinyl propylether, vinyl 2-ethylhexylether and the like.

(D) Thiocarbamate.

The thiocarbamates (D) are compounds represented by the formula $$R^1R^2N—C(X)S—(CR^3R^4)_aY$$

where $R^1$, $R^2$, $R^3$ and $R^4$ are independently hydrogen or hydrocarbyl groups, provided that at least one of $R^1$ or $R^2$ is a hydrocarbyl group; X is oxygen or sulfur; a is 1 or 2; and Y is a hydrocarbyl group, a hetero group (that is, a group attached through a heteroatom such as O, N, or S), an additional $—SC(X)—NR^1R^2$ group, or an activating group.

When a is 2, Y is an activating group. In describing Y as an "activating group," what is meant is a group which will activate an olefin to which it is attached toward nucleophilic addition by, e.g., $CS_2$ or COS derived intermediates. (This is reflective of the method by which this material is normally prepared, by reaction of an activated olefin with $CS_2$ and an amine.) The activating group Y can be, for instance, an ester group, typically but not necessarily a carboxylic ester group of the structure $—COOR^5$. It can also be an ester group based on a non-carbon acid, such as a sulfonic or sulfinic ester or a phosphonic or phosphinic ester. The activating group can also be any of the acids corresponding to the aforementioned esters. Y can also be an amide group, that is, based on the condensation of an acid group, preferably a carboxylic acid group, with an amine. In that case the $—(CR^3R^4)_aY$ group can be derived from acrylamide. Y can also be an ether group, $—OR^5$; a carbonyl group, that is, an aldehyde or a ketone group; a cyano group, —CN, or an aryl group. In one embodiment Y is an ester group of the structure, $—COOR^5$, where $R^5$ is a hydrocarbyl group. $R^5$ can comprise 1 to about 18 carbon atoms, and in one embodiment 1 to about 6 carbon atoms. In one embodiment $R^5$ is methyl so that the activating group is $—COOCH_3$.

When a is 1, Y need not be an activating group, because the molecule is generally prepared by methods, described below, which do not involve nucleophilic addition to an activated double bond.

$R^3$ and $R^4$ can be, independently, hydrogen or methyl or ethyl groups. When a is 2, at least one of $R^3$ and $R^4$ is normally hydrogen so that this compound will be $R^1R^2N—C(S)S—CR^3R^4CR^3HCOOR^5$. In one embodiment most or all of the $R^3$ and $R^4$ groups are hydrogen so that the thiocarbamate will be $R^1R^2N—C(S)S—CH_2CH_2COOCH_3$. (These materials can be derived from methyl methacrylate and methylacrylate, respectively.) These and other materials containing appropriate activating groups are disclosed in greater detail in U.S. Pat. No. 4,758,362, which is incorporated herein by reference.

The substituents $R^1$ and $R^2$ on the nitrogen atom are likewise hydrogen or hydrocarbyl groups, but at least one should be a hydrocarbyl group. It is generally believed that at least one such hydrocarbyl group is desired in order to provide a measure of oil-solubility to the molecule. However, $R^1$ and $R^2$ can both be hydrogen, provided the other R groups in the molecule provide sufficient oil solubility to the molecule. In practice this means that at least one of the groups $R^3$ or $R^4$ should be a hydrocarbyl group of at least 4 carbon atoms. $R^1$ or $R^2$ are preferably alkyl groups of 1 to about 18 carbon atoms, and in one embodiment alkyl groups of 1 to about 8 carbon atoms. In one embodiment, both $R^1$ and $R^2$ are butyl groups. Thus, in one embodiment, the thiocarbamate (D) is S-carbomethoxyethyl-N,N-dibutyl dithiocarbamate which can be represented by the formula

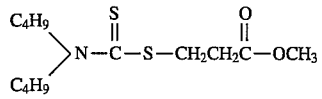

Materials of this type can be prepared by a process described in U.S. Pat. No. 4,758,362. Briefly, these materials are prepared by reacting an amine, carbon disulfide or carbonyl sulfide, or source materials for these reactants, and a reactant containing an activated, ethylenically-unsaturated bond or derivatives thereof. These reactants are charged to a reactor and stirred, generally without heating, since the reaction is normally exothermic. Once the reaction reaches the temperature of the exotherm (typically 40°– 65° C.), the reaction mixture is held at the temperature to insure complete reaction. After a reaction time of typically 3–5 hours, the volatile materials are removed under reduced pressure and the residue is filtered to yield the final product.

The relative amounts of the reactants used to prepare these compounds are not critical. The charge ratios to the reactor can vary where economics and the amount of the product desired are controlling factors. Thus, the molar charge ratio of the amine to the $CS_2$ or COS reactant to the ethylenically unsaturated reactant may vary in the ranges 5:1:1 to 1:5:1 to 1:1:5. In one embodiment, the charge ratios of these reactants is 1:1:1.

In the case where a is 1, the activating group Y is separated from the sulfur atom by a methylene group. Materials of this type can be prepared by reaction of sodium dithiocarbamate with a chlorine-substituted material. Such materials are described in greater detail in U.S. Pat. No. 2,897,152, which is incorporated herein by reference.

(E) Nitrogen-Containing Ester of Carboxy-Containing Interpolymers.

In one embodiment the inventive compositions contain a nitrogen-containing ester of a carboxy-containing interpolymer. These polymers can be nitrogen-containing mixed esters of carboxy-containing interpolymers having a reduced specific viscosity of from about 0.05 to about 2, said ester being characterized by the presence within its polymeric structure of at least one of each of three pendant polar groups: (A) a relatively high molecular weight carboxylic ester group having at least 8 aliphatic carbon atoms in the ester radical, (B) a relatively low molecular weight carboxylic ester group having no more than 7 aliphatic carbon atoms in the ester radical, and (C) a carbonylpolyamino group derived from a polyamino compound having one primary or secondary amino group. In one embodiment, the molar ratio of (A):(B):(C) is (60–90):(10–30):(2–15).

In reference to the size of the ester groups, it is pointed out that an ester group is represented by the formula $$—C(O)(OR)$$

and that the number of carbon atoms in an ester group is thus the combined total of the carbon atom of the carbonyl group and the carbon atoms of the ester group, i.e., the (OR) group.

As used herein, the reduced specific viscosity (abbreviated as RSV) is the value obtained in accordance with the formula $$RSV = \frac{\text{Relative Viscosity} - 1}{\text{Concentration}}$$

wherein the relative viscosity is determined by measuring, by means of a dilution viscometer, the viscosity of a solution of one gram of the interpolymer in 100 ml of acetone and the viscosity of acetone at 30°±0.02° C. For purpose of computation by the above formula, the concentration is adjusted to 0.4 gram of the interpolymer per 100 ml of acetone.

While interpolymers having a reduced specific viscosity of from about 0.05 to about 2 are contemplated in the present invention, particularly useful are interpolymers are those having a reduced specific viscosity of from about 0.3 to about 1, and in one embodiment about 0.5 to about 1.

In one embodiment, the nitrogen-containing mixed esters are those in which the high molecular weight ester group has from 8 to 24 aliphatic carbon atoms, the low molecular weight ester group has from 3 to 5 carbon atoms and the carbonyl polyamino group is derived from a primary-aminoalkyl-substituted tertiary amine, an example being a heterocyclic amine. Specific examples of the high molecular weight carboxylic ester group, i.e., the (OR) group of the ester group (i.e., —(O)(OR)) include heptyloxy, isoctyloxy, decyloxy, dodecyloxy, tridecyloxy, pentadecyloxy, octadecyloxy, eicosyloxy, tricosyloxy, tetracosyloxy, heptacosyloxy, triacontyloxy, bentriacontyloxy, tetracontyloxy, etc. Specific examples of low molecular weight groups include methyloxy, ethyloxy, n-propyloxy, isopropyloxy, n-butyloxy, sec-butyloxy, iso-butyloxy, n-pentyloxy, neo-pentyloxy, n-hexyloxy, cyclohexyloxy, cyclopentyloxy, 2-methylbutyl-1-oxy, 2,3-dimethyl-butyl-1-oxy, etc. In most instances, alkoxy groups of suitable size comprise the high and low molecular weight ester groups. Polar substituents may be present in such ester groups. Examples of polar substituents are chloro, bromo, ether, nitro, etc.

Examples of the carbonylpolyamino group include those derived from polyamino compounds having one primary or secondary amino group and at least one mono-functional amino group such as tertiary amino or heterocyclic amino group. Such compounds may thus be tertiary amino-substituted primary or secondary amines or other substituted primary or secondary amines in which the substituent is derived from pyrroles, pyrrolidones, caprolactams, oxazolidones, oxazoles, thiazoles, pyrazoles, pyrazolines, imidazoles, imidazolines, thiazines, oxazines, diazines, oxycarbamyl, thiocarbamyl, uracils, hydantoins, thiohydantoins, guanidines, ureas, sulfonamides, phosphoroamides, phenolthiazines, amidines, etc. Examples of such polyamino compounds include dimethylamino-ethylamine, dibutylamino-ethylamine, 3-dimethylamino-1-propylamine, 4-methylethylamino-1-butylamine, pyridyl-ethylamine, N-morpholino-ethylamine, tetrahydropyridyl-ethylamine, bis-(dimethylamino)propylamine, bis-(diethylamino)ethylamine, N,N-dimethyl-p-phenylene diamine, piperidyl-ethylamine, 1-aminoethyl pyrazone, 1-(methylamino)pyrazoline, 1-methyl-4-aminooctyl pyrazole, 1-aminobutyl imidazole, 4-aminoethyl thiazole, 2-aminoethyl triazine, dimethylcarbamyl propylamine, N-methyl-N-aminopropyl acetamide, N-aminoethyl succinimide, N-methylamino maleimide, N-aminobutyl-alpha-chlorosuccinimide, 3-aminoethyl uracil, 2aminoethyl pyridine, ortho-aminoethyl-N,N-dimethylbenzenesulfamide, N-aminoethyl phenothiazine, N-aminoethylacetamidine, 1-aminophenyl-2-methyl-imidazoline, N-methyl-N-aminoethyl-S-ethyl-dithiocarbamate, etc. For the most part, the polyamines are those which contain only one primary amino or secondary amino group and, in one embodiment, at least one tertiary-amino group. The tertiary amino group is preferably a heterocyclic amino group. In some instances polyamine compounds may contain up to about 6 amino groups although, in most instances, they contain one primary amino group and either one or two tertiary amino groups. The polyamine compounds may be aromatic or aliphatic amines and are preferably heterocyclic amines such as amino-alkyl-substituted morpholines, piperazines, pyridines, benzopyrroles, quinolines, pyrroles, etc. They are usually amines having from about 4 to about 30 carbon atoms, and in one embodiment from 4 to about 12 carbon atoms. Polar substituents may likewise be present in the polyamines.

The carboxy-containing interpolymers include interpolymers of α,β-unsaturated acids or anhydrides such as maleic anhydride or itaconic anhydride with olefins (aromatic or aliphatic) such as ethylene, propylene, styrene, or isobutene. The styrenemaleic anhydride interpolymers are useful. They are obtained by polymerizing equal molar amounts of styrene and maleic anhydride, with or without one or more additional interpolymerizable comonomers. In lieu of styrene, an aliphatic olefin may be used, such as ethylene, propylene, isobutene. In lieu of maleic anhydride, acrylic acid or methacrylic acid or ester thereof may be used. Such interpolymers are known in the art.

The nitrogen-containing mixed esters are conveniently prepared by first esterifying the carboxy-containing interpolymer with a relatively high molecular weight alcohol and a relatively low molecular weight alcohol to convert at least about 50% and no more than about 98% of the carboxy groups of the interpolymer to ester radicals and then neutralizing the remaining carboxy groups with a polyamine such as described above. To incorporate the appropriate amounts of the two alcohol groups into the interpolymer, the ratio of the high molecular weight alcohol to the low molecular weight alcohol used in the process should be within the range of from about 2:1 to about 9:1 on a molar basis. In most instances the ratio is from about 2.5:1 to about 5:1. More than one high molecular weight alcohol or low molecular weight alcohol may be used in the process; so also may be used commercial alcohol mixtures such as the so-called Oxo-alcohols which comprise, for example, mixtures of alcohols having from about 8 to about 24 carbon atoms. A useful class of alcohols are the commercial alcohols or alcohol mixtures comprising octyl alcohol, decyl alcohol, dodecyl alcohol, tetradecyl alcohol, pentadecyl alcohol, eicosyl alcohol, and octadecyl alcohol. Other alcohols useful in the process are illustrated by those which, upon esterification, yield the ester groups exemplified above.

The extent of esterification, as indicated previously, may range from about 50% to about 98% conversion of the carboxy groups of the interpolymer to ester groups. In one embodiment, the degree of esterification ranges from about 75% to about 95%.

The esterification can be accomplished simply by heating the carboxy-containing interpolymer and the alcohol or alcohols under conditions typical for effecting esterification. Such conditions usually include, for example, a temperature of at least about 80° C., and in one embodiment from about 150° C. to about 350° C., provided that the temperature is below the decomposition point of the reaction mixture, and that water of esterification is removed as the reaction proceeds. Such conditions may optionally include the use of an excess of the alcohol reactant so as to facilitate esterification, the use of a solvent or diluent such as mineral oil, toluene, benzene, xylene or the like and an esterification catalyst such as toluene sulfonic acid, sulfuric acid, aluminum chloride, boron trifluoride-triethylamine, hydrochloric acid, ammonium sulfate, phosphoric acid, sodium methoxide or the like. These conditions and variations thereof are well known in the art.

A useful method of effecting esterification involves first reacting the carboxy-containing interpolymer with the relatively high molecular weight alcohol and then reacting the partially esterified interpolymer with the relatively low molecular weight alcohol. A variation of this technique involves initiating the esterification with the relatively high molecular weight alcohol and before such esterification is complete, the relatively low molecular weight alcohol is introduced into the reaction mass so as to achieve a mixed esterification. In either event it has been discovered that a two-step esterification process whereby the carboxy-containing interpolymer is first esterified with the relatively high molecular weight alcohol so as to convert from about 50% to about 75% of the carboxy groups to ester groups and then with the relatively low molecular weight alcohol to achieve the finally desired degree of esterification results in products which have unusually beneficial viscosity properties.

The esterified interpolymer is then treated with a polyamino compound in an amount so as to neutralize substantially all of the unesterified carboxy groups of the interpolymer. The neutralization can be carded out at a temperature of at least about 80° C., often from about 120° C. to about 300° C., provided that the temperature does not exceed the decomposition point of the reaction mass. In most instances the neutralization temperature is between about 150° C. and 250° C. A slight excess of the stoichiometric amount of the polyamino compound is often desirable, so as to insure substantial completion of neutralization, i.e., no more than about 2% of the carboxy groups initially present in the interpolymer remained unneutralized.

Lubricating Compositions and Functional Fluids

The lubricant and functional fluid compositions of the present invention are based on diverse oils of lubricating viscosity, including natural and synthetic lubricating oils and mixtures thereof. The lubricating compositions may be lubricating oils and greases useful in industrial applications and in automotive engines, transmissions and axles. These lubricating compositions are effective in a variety of applications including crankcase lubricating oils for spark-ignited and compression-ignited internal combustion engines, including automobile and truck engines, two-cycle engines, aviation piston engines, marine and low-load diesel engines, and the like. Also, automatic transmission fluids, transaxle lubricants, gear lubricants, metalworking lubricants, hydraulic fluids, and other lubricating oil and grease compositions can benefit from the incorporation of the compositions of this invention. The inventive functional fluids are particularly effective as automatic transmission fluids having enhanced torque properties.

The lubricants and functional fluid compositions of this invention employ an oil of lubricating viscosity which is generally present in a major amount (i.e. an amount greater than about 50% by weight). Generally, the oil of lubricating viscosity is present in an amount greater than about 60%, or greater than about 70%, or greater than about 80% by weight of the composition.

The natural oils useful in making the inventive lubricants and functional fluids include animal oils and vegetable oils (e.g., castor oil, lard oil) as well as mineral lubricating oils such as liquid petroleum oils and solvent treated or acid-treated mineral lubricating oils of the paraffinic, naphthenic or mixtures thereof which may be further refined by hydrocracking and hydrofinishing processes and are dewaxed. Oils of lubricating viscosity derived from coal or shale are also useful. Synthetic lubricating oils include hydrocarbon oils and halo-substituted hydrocarbon oils such as polymerized and interpolymerized olefins (e.g., polybutylene, polypropylenes, propylene-isobutylene copolymers, chlorinated polybutylenes, etc.); poly(1-hexenes), poly-(1-octenes), poly(1-decenes), etc. and mixtures thereof; alkylbenzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and imerpolymers and derivatives thereof where the terminal hydroxyl groups have been modified by esterification, ethefification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methyl-polyisopropylene glycol ether having an average molecular weight of about 1000, diphenyl ether of polyethylene glycol having a molecular weight of about 500–1000, diethyl ether of polypropylene glycol having a molecular weight of about 1000–1500, etc.) or mono- and polycarboxylic esters thereof, for example, the acetic acid esters, mixed $C_{3-8}$ fatty acid esters, or the $C_{13}$Oxo acid diester of tetraethylene glycol.

Another suitable class of synthetic lubricating oils that can be used comprises the esters of dicarboxylic adds (e.g., phthalic acid, succinic add, alkyl succinic acids, alkenyl succinic acids, maleic acid, azelaic acid, suberic acid, sebacic acid, fumaric acid, adipic acid, tinoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_2$ monocarboxylic adds and polyols and polyol ethers such as neopentyl glycol, trimethylol propane, pentaerythritol, dipentaerythritol, tripemaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methyl-hexyl)silicate, tetra-(p-tert-butylphenyl) silicate, hexyl-(4-methyl-2-pentoxy)disiloxane, poly(methyl) siloxanes, poly-(methylphenyl)siloxanes, etc.). Other synthetic lubricating oils include liquid esters of phosphorus-containing acids (e.g., tricresyl phosphate, trioctyl phosphate, diethyl ester of decane phosphortic acid, etc.), polymeric tetrahydrofurans and the like.

Unrefined, refined and rerefined oils, either natural or synthetic (as well as mixtures of two or more of any of these) of the type disclosed hereinabove can be used in the lubricants of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

In one embodiment, the oil of lubricating viscosity is a poly-alpha-olefin (PAO). Typically, the poly-alpha-olefins are derived from monomers having from about 4 to about 30, or from about 4 to about 20, or from about 6 to about 16 carbon atoms. Examples of useful PAOs include those derived from decene. These PAOs may have a viscosity from about 2 to about 150, or from about 2 to about 100. Examples of PAOs include 4 cSt poly-alpha-olefins, 6 cSt poly-alpha-olefins, 2 cSt poly-alpha-olefins and 100 cSt poly-alpha-olefins. Mixtures of mineral oils with the foregoing poly-alpha-olefins can be useful. Viscosities above are 100° C. kinematic viscosities.

The invention also contemplates the use of lubricants and functional fluids containing other additives in addition to the compositions of this invention. Such additives include, for example, detergems, corrosion-inhibiting agents, antioxidants, viscosity-index improving agents, extreme pressure (E.P.) agents, pour point depressants, friction modifiers, fluidity modifiers, seal swell agents, color stabilizers, dyes, anti-foam agents, etc.

Friction modifiers for use in this invention are presented in U.S. Pat. No. 4,792,410, which is hereby incorporated herein by reference and include metal salts of fatty acids, fatty phosphites, fatty acid amides, fatty amines, glycerol esters, alkoxylated fatty amines, sulfurized olefins, borated alkoxylated fatty amines, borated fatty epoxides, glycerol esters and borated glycerol esters. Friction modifiers may be included in the functional/lubricating fluid at a level of 0.1–10 weight percent. U.S. Pat. No. 5,110,488 discloses metal salts of fatty acids and, in particular, the zinc salts of fatty acids, a preferred embodiment. U.S. Pat. No. 5,110,488 is incorporated herein by reference.

The inventive lubricating compositions and functional fluids can contain one or more detergents or dispersants of the ash-producing or ashless type. The ash-producing detergents are exemplified by oil-soluble neutral and basic salts of alkali or alkaline earth metals with sulfonic acids, carboxylic acids, or organic phosphorus acids characterized by at least one direct carbon-to-phosphorus linkage such as those prepared by the treatment of an olefin polymer (e.g., polyisobutene having a molecular weight of 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The most commonly used salts of such acids are those of sodium, potassium, lithium, calcium, magnesium, strontium and barium.

Ashless detergents and dispersants are so called despite the fact that, depending on its constitution, the dispersant may upon combustion yield a non-volatile material such as boric oxide or phosphorus pentoxide; however, it does not ordinarily contain metal and therefore does not yield a metal-containing ash on combustion. Many types are known in the art, and any of them are suitable for use in the lubricant compositions and functional fluids of this invention. The following are illustrative:

(1) Reaction products of carboxylic acids (or derivatives thereof) containing at least about 34 and preferably at least about 54 carbon atoms with nitrogen containing compounds such as amines, organic hydroxy compounds such as phenols and alcohols, and/or basic inorganic materials. Examples of these "carboxylic dispersants" are described in many U.S. Pat. Nos. including 3,219,666; 4,234,435; and 4,938,881. These include the products formed by the reaction of a polyisobutenyl succinic anhydride with an amine such as a polyethylene amine.

(2) Reaction products of relatively high molecular weight aliphatic or alicydic halides with amines, preferably oxyalkylene polyamines. These may be characterized as "amine dispersants" and examples thereof are described for example, in the following U.S. Pat. Nos. 3,275,554; 3,438,757; 3,454,555; and 3,565,804.

(3) Reaction products of alkyl phenols in which the alkyl group contains at least about 30 carbon atoms with aldehydes (especially formaldehyde) and amines (especially polyalkylene polyamines), which may be characterized as "Mannich dispersants." The materials described in the following U.S. Pat. Nos. are illustrative: 3,649,229; 3,697,574; 3,725,277; 3,725,480; 3,726,882; and 3,980,569.

(4) Products obtained by post-treating the amine or Mannich dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. Pat. Nos. 3,639,242; 3,649,229; 3,649,659; 3,658,836; 3,697,574; 3,702,757; 3,703,536; 3,704,308; and 3,708,422.

(5) Interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. These may be characterized as "polymeric dispersants" and examples thereof are disclosed in the following U.S. Pat. Nos. 3,329,658; 3,449,250; 3,519,565; 3,666,730; 3,687,849; and 3,702,300.

The above-noted patents are incorporated by reference herein for their disclosures of ashless dispersants.

Detergents in the form of overbased metal salts of organic acids are disclosed in U.S. Pat. No. 4,792,410. This document describes borated detergents as the preferred embodiment, but non-borated type detergents are disclosed therein.

The metal salts are preferably alkali metal or alkaline earth metal sulfonates, phenates, oxylates, carboxylates and mixtures thereof. The detergents are incorporated into the present invention at the level of 0.05–3 weight percent.

The inventive lubricating compositions and functional fluids can contain one or more extreme pressure, corrosion inhibitors and/or oxidation inhibitors. Extreme pressure agents and corrosion- and oxidation-inhibiting agents which may be included in the lubricants and functional fluids of the invention are exemplified by chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate; metal thiocarbamates, such as zinc dioctyldithiocarbamate, and barium heptylphenyl dithiocarbamate; dithiocarbamate esters from the reaction product of dithiocarbamic acid and acrylic, methacrylic, maleic, fumaric or itaconic esters; dithiocarbamate containing amides prepared from dithiocarbamic acid and an acrylamide; alkylene-coupled dithiocarbamates; sulfur-coupled dithiocarbamates. Group II metal phosphorodithioates such as zinc dicyclohexylphosphorodithioate, zinc dioctylphosphorodithioate, barium di(heptylphenyl)-phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

Many of the above-mentioned extreme pressure agents and oxidationinhibitors also serve as antiwear agents. Zinc dialkylphosphorodithioates are included in this group.

Specific oxidation-inhibitors that are useful include the mono- and di-para alkylated (e.g., $C_9$) diphenylamines, hydroxythioether made from t-dodecyl mercaptan and propylene oxide, and hydroxyethyl dodecyl sulfide. Specific corrosion-inhibitors that are useful include tolyltriazole and the dialkylated (e.g., $C_9$) sulfur-coupled dimercaptothiadiazoles.

Pour point depressants are a useful type of additive often included in the lubricating oils and functional fluids described herein. The use of such pour point depressants in oil-based compositions to improve low temperature properties of oil-based compositions is well known in the art. See, for example, page 8 of "Lubricant Additives" by C. V. Smalheer and R. Kennedy Smith (Lezius-Hiles Co. publishers, Cleveland, Ohio, 1967). Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. A specific pour point depressant that can be used is the product made by alkylating naphthalene with polychlorinated paraffin and $C_{16}$–$C_{18}$alpha-olefin.

In general, polymethacrylate polymers for use as viscosity modifiers are commercially available from Rohm and Haas in a wide range of molecular weights. The various viscosity modifiers are sold as a function of performance in altering the viscosity properties of oil compositions. Also useful as friction modifiers are polyalkenes such as polyisobutylene. Acrylate viscosity modifiers can be included in final formulations of functional/lubricating fluids at the level of 0–10 weight percent in an oil-free basis. A specific viscosity modifier that can be used is Viscoplex 5151 which is a product of Rohm GMBH identified as a polymethacrylate.

Anti-foam agents are used to reduce or prevent the formation of stable foam. Typical anti-foam agents include silicones or organic polymers. Additional anti-foam compositions are described in "Foam Control Agents," by Henry T. Ketner (Noyes Data Corporation, 1976), pages 125–162.

An example of a fluidity modifier is Hydrocal-38 which is a product Calumet identified as a refined naphthenic oil. An example of a seal swell agent is polyisobutyl-o-aminophenol. Emery 2971, which is a product of Emery identified as a mixture of di- and tri-decyladipate, can function as both a fluidity modifier and a seal swell agent. Ethomeen T/12, which is a product of Armak identified as bis(2-hydroxyethyl) tallowamine, is useful as a friction modifier.

Each of the foregoing additives, is used at a functionally effective amount to impart the desired properties to the lubricant or functional fluid. Thus, for example, if an additive is a dispersant, a functionally effective amount of this dispersant would be an amount sufficient to impart the desired dispersancy characteristics to the lubricant or functional fluid. Similarly, if the additive is an extreme-pressure agent, a functionally effective amount of the extreme-pressure agent would be a sufficient amount to improve the extreme-pressure characteristics of the lubricant or functional fluid. Generally, the concentration of each of these additives, when used, ranges from about 0.001% to about 20% by weight, and in one embodiment about 0.01% to about 10% by weight based on the total weight of the lubricant or functional fluid. The weight percent of the additives are, unless otherwise noted, given on an oil-free basis in both the specification and claims for this invention.

Concentrates

Various additive package components of the inventive compositions as well as one of the other above-discussed additives or other additives known in the art can be added directly to an oil of lubricating viscosity to form a lubricating/functional fluid. In one embodiment, however, they are diluted with a substantially inert, normally liquid organic diluent such as mineral oil, naphtha, benzene, toluene or xylene, to form an additive concentrate. These concentrates usually contain from about 10% to about 90% by weight of the inventive composition and may contain, in addition, one or more other additives known in the art or described hereinabove. The remainder of the concentrate is the substantially inert normally liquid diluent.

TABLE I

| Compound | Weight Percent (oil free) |
|---|---|
| 1. Self condensation Product of thioalkanol | 0.1–2 |
| 2. Esterified maleic-styrene co-polymer and/or Esterified maleic-styrene co-polymer reacted with N-amino-propylmorpholine | 0–10 |
| 3. Dispersant acylpolyamine and/or acylamine boronated | 0.5–5 |
| 4. Borated Compounds, Weight percent Boron | 0.001–1 |
| 5. Dithiocarbamate ester | 0.1–1.5 |
| 6. Triphenyl thiophosphate | 0–1 |
| 7. Alkyl diphenylamine | 0.05–1 |
| 8. Butyrated Hydroxytoluene | 0–1 |
| 9. Friction Modifiers | 0.01–10 |
| 10. Metal salts of organic acids | 0.05–3 |
| 11. Polyisobutylene/polymethacrylate viscosity modifiers | 0–10 |

The additive package components of Table I are added to a base lubricating fluid of suitable viscosity to form the specific lubricating fluid composition. The weight percents of components in Tables I and II are based on the weight of the fully-formulated lubricating/functional fluid composition and are on an oil-free basis. The oil-free basis, of course, excludes Hydrocal 38 and the 85N base oil in Table II. The additive package comprises 5–25 weight percent of the lubricating fluid composition and preferably 10–20 percent. For an automatic transmission fluid (ATF) the package is added to an EXXON WS 2647 base stock which is nominally an 85 neutral mineral oil. Other additives added to the base lubricating fluid to make up the lubricating fluid composition include silicone and fluorosilicone foam inhibitors in the amount of about 100–800 parts per million and a known red dye which is added at a level of 125–500 parts per million. The antifoamants and red dye are used as purchased without consideration for oil content. Also, Hydrocat 38, a napthlenic 40 neutral mineral oil is added to the ATF blend in about 0–5 weight percent to increase fluidity. A preferred ATF composition is shown in Table II.

TABLE II

| Compound | Weight Percent |
|---|---|
| 1. Self condensation Reaction Product of a thioalkanol | 1.5 |
| 2. Acylated polyamine | 2.1 |
| 3. Borated acylated amine | 0.3 |
| 4. Maleic anhydride-styrene co-polymer esterfied with $C_4$–$C_{18}$ alcohols, then reacted with amino-propylomorpholine | 2.2 |
| 5. S-carbomethoxyethyl-N,N-dibutyl dithiocarbamate | 0.5 |
| 6. 2,6 di-tert-butyl-4-methyl phenol | 0–1 |
| 7. Triphenyl thiophosphate | 0.3 |
| 8. Dibutyl phosphate | 0.1 |
| 9. $C_9$ mono and di-paraalkylated dipenylamine | 0.5 |
| 10. Hydrocal 38 (product of Calumet) | 0–5 |
| 11. Red Dye | 0.025 |
| 12. Silicone antifoam agent | 0.042 |
| 13. Base oil 85N | about 85 |

Test Results

An ATF was formulated as illustrated in Table II at about 15 weight percent additive level and tests were run according to general Motors Dexron®-III Automatic Transmission Fluid Specification, GM-6297M, April 1993. Flat Plate Friction tests were run and the results from Mid point torque and lockup are presented in FIGS. 1 and 2. The GM test was modified in terms of energy input in which 27,600 Joules energy input was used versus 15,700 Joules for the GM test procedure. The self condensation product of the alkylthio alkyl ether of bis-n-dodecylthioethyl ether was compared with n-dodecylthio ethanol. The dispersants used were the succan acylated polyamine and the boronated acylated amine. The level lines for both mid-point torque and transmission lock up reveal that friction properties were under control and the values reflect that test results for the invention composition were superior. A further test was run using the General Motors 6M 4L60 transmission. In this the cycles to shift time failure was determined. The ATF containing the invention self condensation product provided 22,500 cycles to failure. The ATF with the thioalcohol failed after 12,500 cycles. The oxidation properties of the ATF with the self condensation product was directionally improved over an ATF containing the thioalcohol.

What is claimed is:

1. A lubricating/functional fluid composition, said composition comprising:

(1) an oil of lubricating viscosity;

(2) self condensation reaction products of an alkylthio alkanols; and (3) a dispersant selected from the group consisting of:

(a) an acylated amine; and (b) a Mannich reaction product.

2. A composition according to claim 1 wherein said reaction products are bis(alkylthioalkyl)ethers.

3. A composition according to claim 1 wherein said alkylthio alkanols are represented by formula:

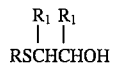

wherein $R=C_4$–$C_{20}$, $R^1$=hydrogen or hydrocarbyl.

4. A composition according to claim 2 wherein said bis(alkylthioalkyl)ethers are at least one of the compounds represented by formula

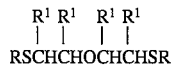

wherein $R=C_4$–$C_{20}$, $R^1$=hydrogen or hydrocarbyl.

5. A composition according to claim 1 wherein said acylated amine is at least one reaction product of a carboxylic acid acylating agent with a polyamine.

6. The composition of claim 5 wherein said polyamine is selected from the group consisting of (1) a product made by contacting at least one hydroxy material with at least one amine; (2) an alkylene polyamine bottoms product; (3) product made by contacting a hydroxy material with an alkylene polyamine bottoms product.

7. A composition according to claim 1 wherein said carboxylic acid acylating agent is a carboxylic acid or a carboxylic anhydride.

8. A composition according to claim 1 wherein said carboxylic acid acylating agent is a succinic acid or succinic anhydride substituted with a hydrocarbon group.

9. The composition according to claim 8 wherein said hydrocarbon group is polyisobutylene.

10. A composition according to claim 1 wherein said composition further comprises a boron compound.

11. A composition according to claim 10 wherein said boron compound is selected from the group consisting of; (1) boronated acylated amine; (2) a boronated epoxide; (3) a boronated fatty acid ester of glycerol; (4) a borated alkoxylated fatty amine.

12. A composition according to claim 10 wherein said boron compound is a boronated succinimide.

13. A composition according to claim 1 wherein said composition further comprises a phosphorus acid or ester or salts thereof.

14. A composition according to claim 13 wherein said phosphorus acid or ester is selected from the group consisting; (1) phosphonic acids; (2) phosphinic acids; (3) thiophosphonic acids; (4) thiophosphinic acids; or a metal or amine salts thereof.

15. A composition according to claim 13 wherein said phosphorus ester is dibutylhydrogen phosphite.

16. A composition according to claim 13 wherein said phosphorus ester is triphenylphosphite or triphenylthiophosphite.

17. A composition according to claim 1 wherein said composition further comprises a thiocarbamate.

18. A composition according to claim 17 wherein said thiocarbamate is at least one compound represented by the formula $R^1R^2N—C(X)S—(CR^3R^4)_aZ$ wherein $R^1$, $R^2$, $R^3$ and $R^4$ are independently hydrogen or hydrocarbyl groups, provided that at least one of $R^1$ and $R^2$ is a hydrocarbyl group; X is oxygen or sulfur; a is 1 or 2; and Z is an activating group, a hydrocarbyl group, a hetero group, or a $SC(A)—NR^1R^2$ group, provided that when a is 2, Z is an activating group.

19. A composition according to claim 18 wherein said thiocarbamate is the reaction product from dibutylamine, carbon disulfide and methyl acrylate.

20. A composition according to claim 1 wherein said composition further comprises a nitrogen containing mixed ester of a carboxy-containing interpolymer.

21. A composition according to claim 20 wherein said nitrogen containing mixed ester is an esterified maleic anhydride-styrene copolymer.

22. A composition according to claim 20 wherein said nitrogen component of said mixed polymer is supplied by N-aminopropylmorpholine.

23. A composition according to claim 1 wherein said composition further comprises a viscosity modifier selected from the group consisting of polymethacrylates and polyisobutylenes, and mixtures thereof.

24. A composition according to claim 1 wherein said composition further comprises a friction modifier.

25. A composition according to claim 1, wherein said dispersant has a TBN of greater than 40.

26. A composition according to claim 1, wherein said composition further comprises:

(a) a boron compound;

(b) a phosphorus acid or ester or salts thereof.

27. A composition according to claim 1, wherein said composition further comprises:

(a) thiocarbamate;

(b) a boron compound.

28. A composition according to claim 1, wherein said composition further comprises:

(a) a thiocarbamate;

(b) a phosphorus acid or ester or salts thereof.

29. A composition according to claim 1, wherein said composition further comprises:

(a) a thiocarbamate;

(b) a boron compound;

(c) a phosphorus acid or ester or salts thereof.

* * * * *